US005325144A

United States Patent [19]

Yoshikawa et al.

[11] Patent Number: 5,325,144

[45] Date of Patent: Jun. 28, 1994

[54] PHOTOGRAPHIC FILM CURLING CORRECTING METHOD AND APPARATUS

[75] Inventors: Sumio Yoshikawa; Katsuhiko Tanaka, both of Kanagawa, Japan

[73] Assignee: Fuji Photo Film Co., Ltd., Kanagawa, Japan

[21] Appl. No.: 46,754

[22] Filed: Apr. 16, 1993

[30] Foreign Application Priority Data

Apr. 20, 1992 [JP] Japan ..... 4-099448

[51] Int. Cl.[5] ..... G03D 3/08

[52] U.S. Cl. ..... 354/319; 354/339

[58] Field of Search ..... 264/160; 242/56; 354/318-322; 355/30

[56] References Cited

U.S. PATENT DOCUMENTS

| | | | |
|---|---|---|---|
| 3,552,668 | 1/1971 | Kanno | 242/56 |
| 3,806,574 | 4/1974 | Arvidson, Jr. | 264/160 |
| 3,939,000 | 2/1976 | Arvidson, Jr. et al. | 422/171 X |
| 5,093,686 | 3/1992 | Shigaki | 355/77 |
| 5,124,743 | 6/1992 | Shiota | 355/30 |

*Primary Examiner*—D. Rutledge

*Attorney, Agent, or Firm*—Sughrue, Mion, Zinn, Macpeak & Seas

[57] ABSTRACT

A photographic film curling correcting method and apparatus for correcting curling of a photographic film generated when the photographic film is stored for a long time in a cartridge in a state in which the photographic film is taken up around a spool shaft in a form of a roll, comprising the steps of: curvilinearly conveying the photographic film, which is withdrawn from the cartridge, so that the curling of the photographic film generated by taking up of the photographic film around the shaft becomes an opposite direction; and relaxing the curling by heating the photographic film while the photographic film is being curvilinearly conveyed, and taking up the photographic film, whose curling has been relaxed, into the cartridge again while cooling the photographic film. The curling of the photographic film can be corrected before developing processing when the photographic film is initially printed and before printing processing when the photographic film is printed a second time or times thereafter.

17 Claims, 14 Drawing Sheets

PHOTOGRAPHIC FILM CURLING CORRECTING METHOD AND APPARATUS

BACKGROUND OF THE INVENTION

1. Field of the Invention

The present invention relates to a photographic film curling correcting method and apparatus for correcting curling of photographic film generated when the photographic film is stored in a cartridge in which the photographic film is taken up around a shaft in the form of a roll and is accommodated.

2. Description of the Related Art

After being photographed, a photographic film is loaded and accommodated in a cartridge. In a so-called strip processing developing apparatus in which the photographic film is withdrawn from the cartridge and is subject to developing processing, it is detected that the photographic film is completely withdrawn from the cartridge, the final end of the photographic film is cut, and processing is effected continuously. A guiding member, called a short leader, is adhered to the leading end portion of the photographic film. As the short leader is guided and conveyed, developing processing and photosensitive processing are effected. In this type of strip processing, curling of the leading end portion of the photographic film is eliminated by the short leader. However, when the photographic film is taken up onto the spool, curling is most strong at the lowermost layer (i.e., the trailing end portion). Therefore, when the photographic film is curled in the form of a loop, the loop is crushed by a roller, and the photographic film is bent.

In recent years, a system has been proposed in which the photographed photographic film is taken up again into the cartridge and returned to the customer in that way. In such a case, it is possible to have the tongue remain out of the cartridge by reversely rotating the spool shaft on which the photographic film is accommodated. Therefore, when reprinting or the like is requested, the cartridge is loaded into the printing apparatus, and printing processing is effected.

The curling of the trailing end portion of the photographic film taken up in this type of cartridge is strong.

Further, as cameras are being made more compactly, the idea of accommodating photographic films in small cartridges has also been conceived. As in the above-described case, curling is strong in these small cartridges as well.

As a result, measures to correct curling in advance, such as attaching a short leader to the trailing end portion of the photographic film as well, have been proposed. However, when reprinting or the like is requested after initial printing (simultaneous printing) has been completed, i.e., for the second printing or times thereafter, the photographic film is directly loaded into a printing apparatus without being processed into strips. Therefore, the film must be dealt with in a state in which the curling thereof is strong.

It is best to continuously provide a conveying path, which can smoothly guide the curled photographic film, from the photographic film withdrawing position to the heating processing position. However, for example, when the loading portion into which the photographic film is loaded is a cassette-type loading portion which can be separated from the conveying path of the photographic film, it is necessary to transfer the photographic film between the loading portion and the conveying path of the photographic film.

However, because there is strong curling in the photographic film, the leading edge of the photographic film enters into the gap of the transferring portion at which the photographic film is transferred from the loading portion to the photographic film conveying path. Trouble in the conveying of the photographic film, such as jamming or the like, may therefore occur.

When a plurality of curled photographic films are processed, the photographic films are withdrawn one by one, and workability is poor. Therefore, a cassette-type loading portion in which a plurality of cartridges can be loaded is used. The plurality of loaded cartridges are successively positioned at a photographic film withdrawing position. The respective spool shafts of the cartridges loaded in the loading portion are respectively connected to gears provided in the loading portion. These gears mesh with a driving gear at the photographic film withdrawing position. In this way, a plurality of photographic films can be automatically processed.

The photographic film, which has undergone curling correcting processing, is taken up again into the cartridge. Therefore, when the loading portion is viewed from the exterior thereof, it cannot be determined if the cartridges loaded therein have been processed or have not yet been processed. Further, when the loading portion is not completely filled with cartridges, an empty section of the loading portion is positioned at the photographic film withdrawing position, and the apparatus may make an error in operation. Further, the processing time is made longer than necessary.

Moreover, when the cartridges are positioned successively, a shock is generated when the gears connected to the respective cartridges mesh with the driving gear at the predetermined position. There is therefore the fear that a loss of synchronism may be generated in the motor due to the step-movement of the loading portion.

Generally, a drum is optimal for curving the photographic film in a direction opposite to the curling thereof. A pair of flanges are formed on the drum in order to stably convey the photographic film. The photographic film is guided and conveyed by the pair of flanges.

Further, it is preferable that the outer circumference of the drum contacts a drive roller and that the drum is rotated by the driving of the drive roller because of the reduction in the torque of the shaft of the drum and because a heating means is accommodated within the drum.

However, when dirt adheres to the outer circumference of the drum and especially to the surface around which the photographic film is trained, the photographic film may be damaged or it may not be possible to effect stable heating processing or the like. Therefore, the outer circumference of the drive roller has adhesion, and the dirt adhering to the circumferential surface of the drum is removed in accordance with the rotation of the drive roller (i.e., the dirt adheres to the drive roller). When a predetermined amount of dirt has adhered to the heat roller, the heat roller may be changed.

However, because the flanges are formed on the drum, a portion of the drive roller is accommodated between the flanges. Therefore, it is necessary to remove the drum as well when the drive roller is changed when the predetermined amount of dirt is to be removed therefrom. Workability therefore deteriorates.

SUMMARY OF THE INVENTION

In view of the aforementioned, an object of the present invention is to provide a photographic film curling correcting method and apparatus in which curling of photographic film can be corrected before developing processing when a film is initially printed and before printing processing when the photographic film is printed a second time or times thereafter.

Another object of the present invention is to provide a photographic film curling correcting apparatus in which a strongly curled photographic film can be smoothly transferred between separated conveying paths of the photographic film.

Another object of the present invention is to provide a photographic film curling correcting apparatus in which it can be determined from the exterior of a loading portion if cartridges loaded therein have been subject to curling correcting processing or have not yet been subject to curling correcting processing.

In addition to the above-described objects, an object of the present invention is to provide a photographic film curling correcting apparatus in which the existence of a cartridge within the loading portion is detected, and curling correcting operations are not effected when there is no photographic film within the loading portion so that there is no waste in processing time.

Another object is to provide a photographic film curling correcting apparatus in which the loading portion is moved smoothly.

Yet another object of the present invention is to provide a photographic film curling correcting apparatus in which members used for removing dirt can be easily removed without interfering with any other members so that maintenance workability can be improved.

Another object is to provide a photographic film curling correcting apparatus in which irregularities in density, deformation, and damage caused by heating can be suppressed and the curling of the photographic film can be corrected.

A first aspect of the present invention is a photographic film curling correcting method for correcting curling of photographic film generated when the photographic film is stored for a long time in a cartridge in which the photographic film is taken up around a shaft in a form of a roll and is accommodated, comprising the steps of: curvilinearly conveying the photographic film, which is withdrawn from the cartridge, so that the curling of the photographic film generated by taking up of the photographic film around the shaft becomes an opposite direction; and relaxing the curling by heating the photographic film while the photographic film is being curvilinearly conveyed, and taking up the photographic film, whose curling has been relaxed, into the cartridge again while cooling the photographic film.

A second aspect of the present invention is a photographic film curling correcting apparatus for correcting curling of photographic film generated when the photographic film is stored for a long time in a cartridge in which the photographic film is taken up around a shaft in a form of a roll and is accommodated, comprising: a loading portion in which the cartridge is loaded; conveying means for conveying the photographic film from the cartridge, which is loaded in the loading portion, in one of a direction of withdrawing the photographic film and a direction of taking up the photographic film; withdrawing control means for controlling the conveying means and withdrawing the photographic film from the cartridge; a heat roller around which the photographic film withdrawn from the cartridge is trained in a direction opposite to the direction of taking up the photographic film onto the shaft, a surface of the heat roller being heated by a heating means so that the heat roller heats the trained photographic film; an accommodating portion for temporarily accommodating the photographic film heated by the heat roller; detecting means for detecting that the photographic film has been completely withdrawn from the cartridge; taking up control means for controlling the conveying means to reversely convey the photographic film from the accommodating portion along a same conveying path and for taking up the photographic film into the cartridge again when the detecting means detects that the photographic film has been completely withdrawn; and, cooling means for cooling the photographic film when the photographic film is taken up by the taking up control means.

A third aspect of the present invention is a photographic film curling correcting apparatus for correcting curling of photographic film generated when the photographic film is stored for a long time in a cartridge in which the photographic film is taken up around a shaft in a form of a roll and is accommodated, comprising: a loading portion in which the cartridge is loaded; a heat roller whose surface is heated by a heating means, and which corrects curling of the photographic film; conveying means for completely withdrawing and taking up the photographic film when the photographic film has not been subject to developing processing, and for withdrawing and taking up only a leading end portion upon which images are not printed when the photographic film has been subject to developing processing, when the photographic film is taken up again into the cartridge after having been withdrawn from the cartridge loaded in the loading portion and having been trained around the heat roller in a direction opposite to a direction of taking up the photographic film onto the shaft; and, cooling means for cooling the photographic film when the photographic film is taken up by the conveying means.

A fourth aspect of the present invention is a photographic film curling correcting apparatus for correcting curling of photographic film generated when the photographic film is stored in a cartridge in which the photographic film is taken up around a spool shaft in a form of a roll and is accommodated, the photographic film having a leader portion whose leading edge is cut obliquely from one transverse direction end thereof to another transverse direction end thereof, the photographic film curling correcting apparatus comprising: a loading portion in which the cartridge is loaded; a first guide path guiding the photographic film withdrawn from the cartridge loaded in the loading portion, a continuous or intermittent first stepped portion being formed from a side towards a leadingmost edge of the leader portion and along a transverse direction of the photographic film at a leading edge, in a conveying direction of the photographic film, of the first guide path; a heat roller around which the photographic film is trained in a direction opposite to a direction of taking up the photographic film into the cartridge, a surface of the heat roller being heated up by the heating means so that the heat roller heats the trained photographic film; and a second guide path guiding the photographic film, which is transferred from the first guide path, to the heat roller, a continuous or intermittent second stepped portion being formed at an edge of the second guide path which opposes the first guide path so that convex and concave portions of the second stepped portion and the first stepped portion of the first guide path correspond to each other.

A fifth aspect of the present invention is a photographic film curling correcting apparatus in which a photographic film, which is accommodated in a cartridge in a state in which the photographic film is taken up around a spool shaft in a form of a roll, is withdrawn by a driving means, the photographic film is heated while curved in a direction opposite to a direction of curling generated by the photographic film being taken up around the spool shaft, and the photographic film curling correcting apparatus corrects the curling of the photographic film, and thereafter, the photographic film is accommodated in the cartridge again, the photographic film curling correcting apparatus comprising: a loading portion provided with a plurality of loading grooves in which the cartridges are loaded, and moving the loading grooves successively to a photographic film withdrawing position; a driving shaft protruding from a bottom portion of the loading groove into the loading groove, the driving shaft being provided with a shaft portion engageable with the spool shaft of the cartridge and being provided with a gear attached to the shaft portion and receiving driving force from the driving means so as to rotate, the driving shaft being movable in an axial direction thereof; urging means for urging the driving shaft to move axially in a direction of the loading groove; retaining means for retaining the cartridge when the cartridge is accommodated in the loading groove and the shaft portion of the driving shaft is moved axially against urging force of the urging means; and, releasing means for releasing the cartridge, for which curling correction processing has been completed, from being retained by the retaining means in accordance with positioning movement of the loading portion.

A sixth aspect of the present invention is a photographic film curling correcting apparatus in which a photographic film, which is accommodated in a cartridge in a state in which the photographic film is taken up around a spool shaft in a form of a roll, is withdrawn by a driving means, the photographic film is heated while curved in a direction opposite to a direction of curling generated by the photographic film being taken up around the spool shaft, and the photographic film curling correcting apparatus corrects the curling of the photographic film, and thereafter, the photographic film is accommodated in the cartridge again, the photographic film curling correcting apparatus comprising: a loading portion provided with a plurality of loading grooves in which the cartridges are loaded, and moving the loading grooves successively to a photographic film withdrawing position; a driving shaft protruding from a bottom portion of the loading groove into the loading groove, the driving shaft being provided with a shaft portion engageable with the spool shaft of the cartridge and being provided with a gear attached to the shaft portion and receiving driving force from the driving means so as to rotate, the driving shaft being movable in an axial direction thereof; urging means for urging the driving shaft to move axially in a direction of the loading groove; a sensor detecting existence of the cartridge in the loading groove by detecting an axial direction position of the driving shaft; and, driving controlling means for controlling driving by the driving means to withdraw the photographic film based on results of detection of the sensor.

A seventh aspect of the present invention is a photographic film curling correcting apparatus in which a photographic film, which is accommodated in a cartridge in a state in which the photographic film is taken up around a spool shaft in a form of a roll, is withdrawn by a driving means, the photographic film is heated while curved in a direction opposite to a direction of curling generated by the photographic film being taken up around the spool shaft, and the photographic film curling correcting apparatus corrects the curling of the photographic film, and thereafter, the photographic film is accommodated in the cartridge again, the photographic film curling correcting apparatus comprising: a loading portion provided with a plurality of loading grooves in which the cartridges are loaded, and moving the loading grooves successively to a photographic film withdrawing position; a driving shaft protruding from a bottom portion of the loading groove into the loading groove, the driving shaft being provided with a shaft portion engageable with the spool shaft of the cartridge and being provided with a gear attached to the shaft portion and receiving driving force from the driving means so as to rotate, the driving shaft being movable in an axial direction thereof; rotation controlling means for rotating a gear of the driving means, which meshes with the gear when the loading portion is moving so as to position the loading grooves of the loading portion, temporarily along a direction of movement of the loading portion.

An eighth aspect of the present invention is a photographic film curling correcting apparatus for correcting curling of a photographic film generated when the photographic film is stored in a cartridge in which the photographic film is taken up around a spool shaft in a form of a roll and is accommodated, comprising: a loading portion in which the cartridge is loaded; a heat roller around which the photographic film is trained in a direction opposite to a direction in which the photographic film is taken up into the cartridge, a surface of the heat roller being heated by a heating means so that the trained photographic film is heated, flanges being formed on the heat roller in a direction of thickness of the heat roller, the photographic film withdrawn from the cartridge loaded in the loading portion being guided between the flanges; a first roller, a portion of the first roller being accommodated in the flanges of the heat roller so as to contact a circumferential surface of the heat roller, the first roller having adhesion so that dirt clinging to the circumferential surface adheres to the first roller; and, dirt removing means disposed at a position other than between the flanges for removing dirt adhering to the first roller.

A ninth aspect of the present invention is a photographic film curling correcting apparatus for correcting curling of a photographic film generated when the photographic film is stored for a long time in a cartridge in which the photographic film is taken up around a spool shaft in a form of a roll and is accommodated, comprising: a loading portion in which the cartridge is loaded; a heat roller around which the photographic film withdrawn from the cartridge is trained in a direction opposite to a direction in which the photographic film is taken up onto the spool shaft, a surface of the heat roller being heated by a heating means so that the heat roller heats the trained photographic film; an accommodating portion taking up the photographic film heated by the heat roller onto a take-up shaft and accommodating the heat roller; conveying means for rotating the heat roller at a predetermined rotational speed and for conveying the photographic film at a constant speed from the spool shaft to the accommodating portion or from the accommodating portion to the spool shaft; first rotating means engageable with the spool shaft of the cartridge positioned at a predetermined position of the loading portion, for rotating the spool shaft at torque lower than rotational torque of the heat roller; second rotating means engaging with the take-up shaft, for rotating the take-up shaft at torque lower than the rotational torque of the heat roller; and switching means for switching between a first position, at which the first rotating means is rotated at a speed slower than a speed of the heat roller and the second rotating means is rotated at a speed faster than the speed of the heat roller when the photographic film is withdrawn from the spool shaft, and a second position, at which the first rotating means is rotated at a speed faster than the speed of the heat roller and the second rotating means is rotated at a speed slower than the speed of the heat roller when the photographic film is taken up onto the spool shaft.

In accordance with the first aspect of the present invention, curling is formed in the photographic film which is taken up around the shaft of the cartridge. The curling becomes stronger the longer the photographic film is maintained in this state. When the photographic film is processed, there is strong curl especially in the trailing end portion thereof, which results in poor conveying of the photographic film. Therefore, before processing, the photographic film is withdrawn from the cartridge and is curvilinearly conveyed so that the curling of the photographic film generated by the taking up of the photographic film around the shaft becomes an opposite direction. By heating the photographic film as it is conveyed in a curve, the curling thereof is relaxed.

The photographic film is taken up again into the cartridge in a state in which curling thereof is relaxed. At this time, if the temperature of the photographic film is high, it will again be curled. Therefore, the photographic film whose curling has been corrected is accommodated in the cartridge while being cooled.

A short while after, the cartridge is loaded into a developing apparatus or a printing apparatus. The photographic film is withdrawn from the cartridge. Because the curling thereof is weak, the photographic film can be processed without any problems occurring in the conveying thereof.

Namely, in the first aspect, the strong curling which results from the photographic film being taken up around the shaft for a long time can be relaxed before processing (developing processing or printing processing). Therefore, for example, when a developed photographic film is returned to a customer while accommodated in a cartridge and thereafter, the customer requests reprinting of the photographic film, the curling thereof can be reliably relaxed.

In accordance with the second aspect of the present invention, when the cartridge in loaded into the loading portion and the conveying means is driven by the withdrawing control means, the photographic film is withdrawn from the cartridge and is trained around the heat roller whose surface is heated by the heating means. The direction of the training of the photographic film is opposite to the direction of the curling caused by the photographic film being taken up around the shaft. Therefore, the curling of the photographic film heated by the heat roller is relaxed. The photographic film heated by the heat roller is temporarily accommodated at an accommodating portion.

When the trailing end portion of the photographic film is detected by the detecting means, the taking up control means controls the conveying means so that the photographic film is conveyed backwards along the same conveying path. The photographic film is cooled while being taken up again into the cartridge.

In this way, the strong curling of the photographic film within the cartridge is eliminated. If developing processing or printing processing is effected within a short time, there are no problems in conveying the photographic film during these processes.

In accordance with the third aspect of the present invention, in a photographic film which has been subject to developing processing, only the curling at the leading end portion thereof presents difficulties during printing processing. Namely, if the leading end portion is curled, the photographic film is conveyed poorly when sent into a film carrier.

Further, from the standpoint of the characteristics of the photographs, it is preferable that the image surface not be heated at a high temperature after developing processing. It is best to avoid heating the image surface of photographic film after developing processing. Accordingly, by applying heat to and correcting the curling of only the leading end portion of the photographic film where the image surface is not formed, the conveyability of the photographic film improves, and the images are not damaged.

According to the fourth aspect of the present invention, curling is formed in the photographic film which is taken up around the shaft of the cartridge. The curling becomes stronger the longer the photographic film is maintained in this state. When the photographic film is processed, there is strong curl especially in the trailing end portion thereof, which leads to difficulty in conveying the photographic film at a splicer, a developer, a printer, or the like. In the fourth aspect, the cartridge is loaded into the loading portion, and the photographic film is withdrawn and conveyed while being guided by the first guide path. The photographic film which passes over the first guide path is transferred to the second guide path.

Continuous or intermittent steps are formed at the opposing surfaces of the first guide path and the second guide path. The leadingmost edge of the leader portion is first transferred to the second guide path. Because the leadingmost edge is supported by the convex portion of the first guide path, the photographic film is transferred in a state in which the curving thereof caused by the curling is reduced.

The leadingmost edge of the leader portion which is transferred to the second guide path is slid and conveyed along the convex portion of the second guide path. Therefore, the photographic film does not enter into the gap between the first guide path and the second guide path and is therefore transferred smoothly.

As a result, even if, for example, the loading portion is a cassette style loading portion and is removable, the conveyability of the photographic film does not deteriorate.

Heat is applied to correct the curling of the photographic film which is transferred to the second guide path. Heat is applied uniformly from the leading end to the trailing end of the photographic film so that the curling thereof can be corrected.

The stepped portions of the first guide path and the second guide path may be formed as convex and concave portions which mesh together. Alternatively, the stepped portions may be formed as inclined surfaces which are inclined from one transverse direction end of the photographic film to the other. In this case, the step may be formed so that the leadingmost edge of the leader portion is first transferred to the second guide path.

In accordance with the fifth aspect of the present invention, curling is formed in the photographic film which is taken up around the shaft of the cartridge. The curling becomes stronger the longer the photographic film is maintained in this state. When the photographic film is processed, there is strong curl especially in the trailing end portion thereof, which leads to difficulty in conveying the photographic film at a splicer, a developer, a printer, or the like. In the fifth aspect, cartridges are loaded into a plurality of loading grooves of the loading portion. A shaft portion of a driving shaft is protruded by the urging force of the urging means. The cartridge is pushed in against the urging force of the urging means and is maintained by the maintaining means. Loading of the cartridge is thereby completed.

Thereafter, the loading portion is moved, and the photographic film is withdrawn from the cartridge positioned at the photographic film withdrawing position. Curling correcting processing is then effected. After curling correcting processing has been completed, the photographic film is again accommodated within the cartridge. The loading portion is step-moved so that the next cartridge is positioned at the photographic film withdrawing position. The same processes are then effected.

After processing has been completed in the loading portion, the held state of the cartridge by the holding means is released by the releasing means. In this way, the driving shaft is moved in the direction of the loading groove by the urging force of the urging means, and a portion of the cartridge is thereby protruded from the loading groove. Therefore, the accommodated states of cartridges which have been processed and cartridges which have not yet been processed are different, and it can be determined by looking at the exterior of the cartridge if a cartridge has been subject to processing or not.

In accordance with the sixth aspect of the present invention, due to the urging force of the urging means, the axial direction position of the driving shaft is different when a cartridge is loaded in the loading groove and when a cartridge is not loaded therein. The sensor determines the axial direction position of the driving shaft, and the existence of the cartridge within the loading groove is thereby detected. When, for example, a loading groove in which no cartridge is loaded is positioned, the driving control means allows the driving operation for withdrawing the photographic film to be bypassed so that operations for curling correcting processing are not effected for an empty loading groove.

In accordance with the eighth aspect of the present invention, curling is formed in the photographic film which is taken up around the shaft of the cartridge. The curling becomes stronger the longer the photographic film is maintained in this state. When the photographic film is processed, there is strong curl especially in the trailing end portion thereof, which leads to difficulty in conveying the photographic film at a splicer, a developer, a printer, or the like. In the eighth aspect, the cartridge is loaded into the loading section, and the photographic film is withdrawn and trained around a heat roller in a curve in a direction opposite to the direction of the curling. The photographic film is heated so that the curling thereof can be corrected.

When dirt adheres to the circumferential surface of the heat roller, the photographic film trained therearound may be damaged, or uniform heating of the photographic film may be prevented which leads to portions of the photographic film deforming or irregularities in density. By the dirt adhering to the first roller, the circumferential surface of the heat roller can always be kept clean. Because the dirt adhering to the first roller increases over time, it is necessary to remove the dirt.

However, because a portion of the first roller is accommodated between the pair of flanges of the heat roller, the first roller cannot be easily removed. Therefore, in the eighth aspect, the dirt adhering to the first roller can be remove by the dirt removing means. The dirt removing means can be removed without interfering with the heat roller or the first roller. Therefore, changing and cleaning work can be effected smoothly when a predetermined amount of dirt has accumulated on the dirt removing means.

In accordance with the ninth aspect of the present invention, curling is formed in the photographic film which is taken up around the shaft of the cartridge. The curling becomes stronger the longer the photographic film is maintained in this state. When the photographic film is processed, there is strong curl especially in the trailing end portion thereof, which leads to difficulty in conveying the photographic film at a splicer, a developer, a printer, or the like. In the ninth aspect, the cartridge is loaded into the loading portion, and the conveying means is operated when the switching means switches to the first position. Accordingly, the spool shaft is rotated by the first rotating means at a speed slower than the speed at which the photographic film is conveyed at the heat roller by the conveying means, whereas the take-up shaft is rotated by the second rotating means at a speed faster than the speed at which the photographic film is conveyed at the heat roller by the conveying means. The rotational torques of both of the shafts (the spool shaft and the take-up shaft) are lower than the rotational torque of the heat roller. Therefore, the photographic film is conveyed smoothly without slack and without being subject to more tension than necessary. Further, because the conveying speed of the photographic film conveyed by the heat roller is constant, the amount of heat applied to the photographic film is uniform.

Accordingly, there is no unnecessary slack or tension applied to the photographic film, and damage to the image surface thereof can be prevented. Further, because the photographic film is conveyed at a constant speed at the heat roller, the heat applied for curling correction is uniform from the leading end of the photographic film to the trailing end thereof. Even if the density of the photographic film is effected by heat, irregularities in the density are not generated.

As described above, in the photographic film curling correcting method and apparatus of the first through the third aspects, a superior effect can be achieved in that the curling of the photographic film can be corrected before developing processing when the photographic film is initially printed and before printing processing when the photographic film is printed a second time or times thereafter.

In the photographic film curling correcting apparatus of the fourth aspect as described above, an excellent effect can be achieved in that the strongly curled photographic film can be smoothly transferred between conveying paths which are separated from each other.

The photographic film curling correcting apparatus of the first aspect as described above has an outstanding effect in that it can be determined by looking at cartridges loaded within the loading portion if the cartridges have been subject to curling correcting processing or have not yet been subject to curling correcting processing.

Further, in addition to the above-mentioned effects, in the sixth aspect of the present invention as described above, the existence of a cartridge within the loading portion is detected so that operations for curling correcting processing are not effected when there is no cartridge. In this way, a waste in processing time can be eliminated.

Moreover, in the seventh aspect of the present invention as described above, when the loading portion is moved so as to position a loading groove at the photographic film withdrawing position, the gear of the driving means is temporarily rotated by the rotating means in a direction along the direction of movement of the loading portion. In this way, the shock which occurs when this gear and the gear attached to the driving shaft mesh can be lessened, and the loading portion can be moved smoothly.

In the photographic film curling correcting apparatus of the eighth aspect of the present invention as described above, a superior effect is achieved in that a member used for removing dirt can be easily removed without interfering with any other members so that maintenance workability can be improved.

The photographic film curling correcting apparatus of the ninth aspect of the present invention as described above has an outstanding effect in that damage, such as irregularities in density and deformation, to the photographic film which is caused by heating can be repressed and the curling of the photographic film can be corrected.

DESCRIPTION OF THE PREFERRED EMBODIMENTS

Figure 1:
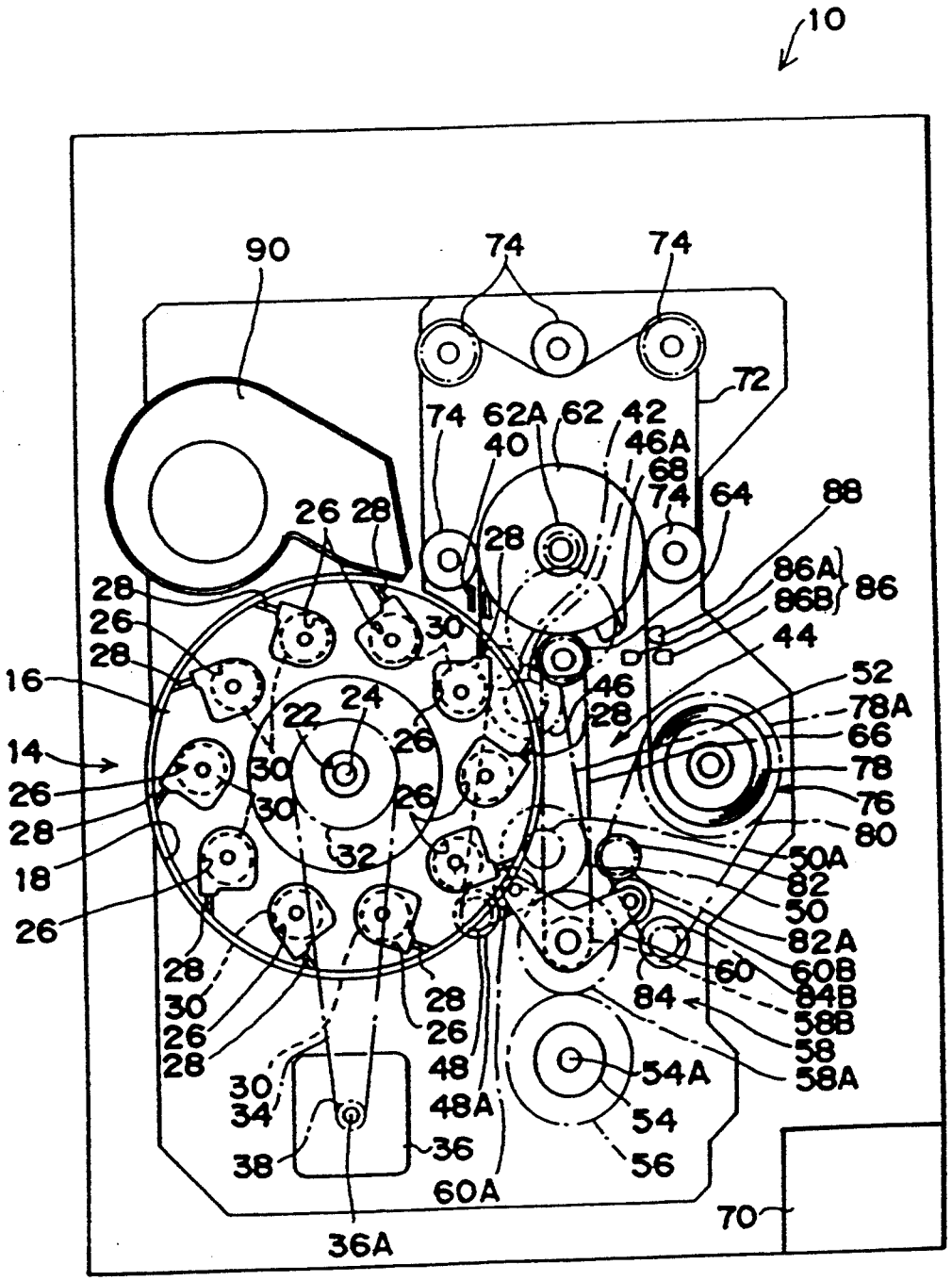
FIG. 1 is a schematic plan view of a negative film curling correcting apparatus relating to the present embodiment.

FIG. 1 illustrates a negative film curling correcting apparatus 10 of the present invention. The curling correcting apparatus 10 is provided with a loading section 14 in which a plurality of cartridges 12 can be accommodated at the time. In the present embodiment, ten cartridges are loaded in the loading section 14.

The loading section 14 includes a cylinder portion 16, in which the cartridges 12 are loaded, and a cylinder loading portion 18 in which the cylinder portion 16 is loaded.

Figure 2:
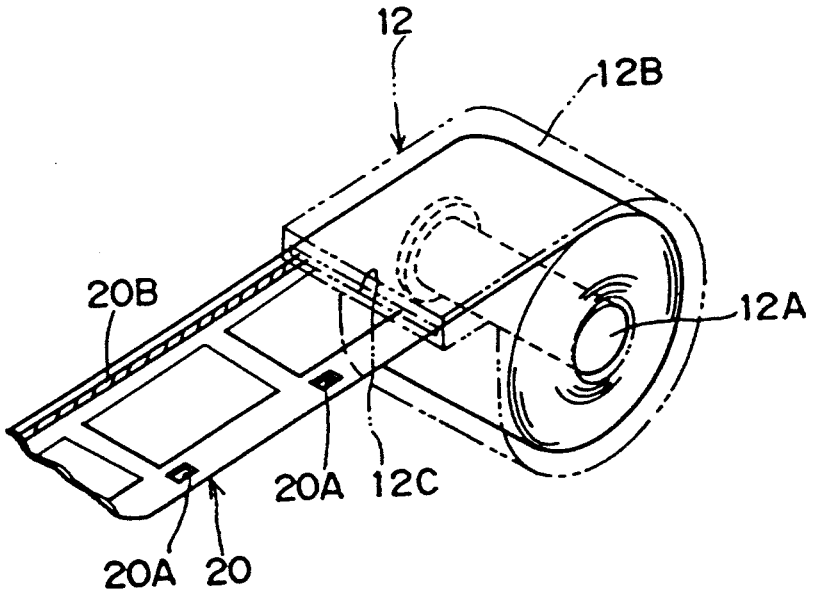
FIG. 2 is a perspective view illustrating an interior of a cartridge and a negative film.

As illustrated in FIG. 2, the cartridge 12 includes a spool shaft 12A, which takes up a negative film 20 in the form of a roll, and a case portion 12B, which covers the negative film 20 taken up onto the spool shaft 12A. A negative film withdrawal opening 12C is provided in the case portion 12B in a direction tangent thereto. The negative film 20 is withdrawn from the negative film withdrawal opening 12C.

A perforation 20A is provided for each image frame of the negative film 20. The perforations 20A are used in positioning and the like during printing. Further, a strip-like magnetic recording layer 20B is provided at one transverse direction end portion of the negative film 20 at a region other than the image recording surface. Information at the time of photographing and the like is magnetically recorded on the magnetic recording layer 20B.

In the present embodiment, the negative film 20 is accommodated tightly in the cartridge 12. Namely, the outermost layer of the negative film 20 contacts the inner peripheral surface of the case portion 12B. As a result, when the spool shaft 12A is rotated in a direction of withdrawing the negative film 20, the leading end portion of the outermost layer of the negative film 20 is withdrawn from the negative film withdrawal opening 12C.

A through-hole 22 is provided at the axial center of the cylinder portion 16 so as to penetrate through both end surfaces thereof. A supporting shaft 24 is provided, so as to be axially rotatable, in the center of the cylinder loading portion 18, which corresponds to the through-hole 22. The cylinder portion 16 is supported by the supporting shaft 24.

When the supporting shaft 24 rotates, the cylinder portion 16 rotates in a state in which the cylinder portion 16 is accommodated in the cylinder loading portion 18. Further, an unillustrated lock lever is provided at an end portion of the supporting shaft 24. Axial movement of the cylinder portion 16 is prevented by operation of the lock lever when the cylinder portion 16 is accommodated in the cylinder loading portion 18.

Ten cartridge loading grooves 26 are provided in one end surface of the cylinder portion 16. The cartridge loading grooves 26 are spaced evenly around the axis of the cylinder portion 16 at the same position in the radial direction thereof.

A wall portion forming the inner periphery of the cartridge loading groove 26 is formed in substantially the same configuration as the shape of the outer periphery of the cartridge 12. A guide path 28, through which the negative film 20 passes, is provided from one portion of the wall portion in a direction tangent to the cartridge loading groove 26. The guide path 28 extends to the outer circumference of the cylinder portion 16 such that the negative film 20, which is withdrawn from the cartridge 12 accommodated in the cartridge loading groove 26, can be delivered to the outer circumference of the cylinder portion 16.

Figure 4:
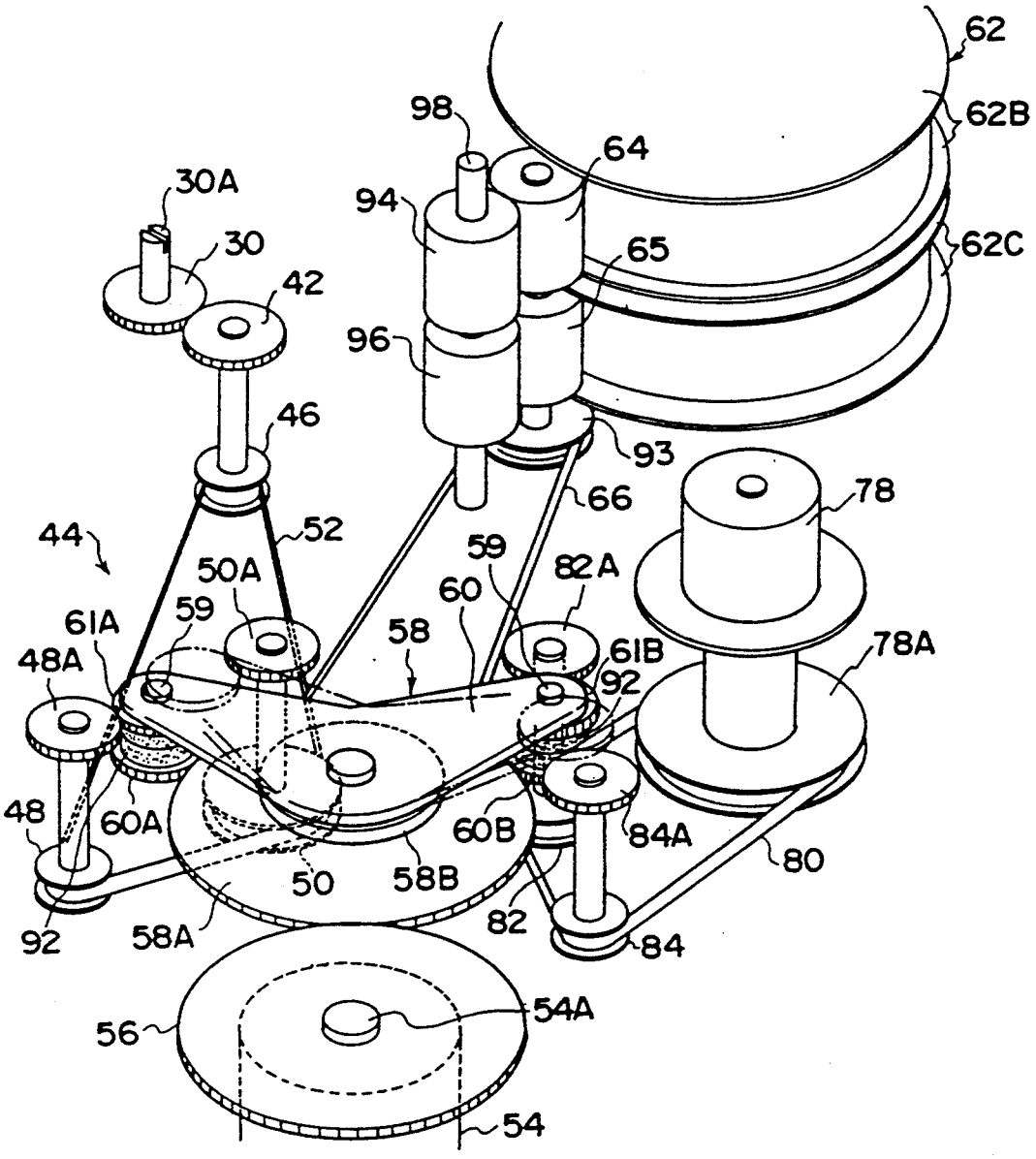
FIG. 4 is a perspective view illustrating an outline of a drive force transmitting portion.

A gear 30 illustrated in FIG. 4 is attached to the bottom portion of the cartridge loading groove 26. A shaft portion 30A of the gear 30 and the spool shaft 12A of the cartridge 12 fit together. The spool shaft 12A is rotated by the rotation of the gear 30 so that the negative film 20 can be withdrawn from the cartridge 12.

Figure 10A:
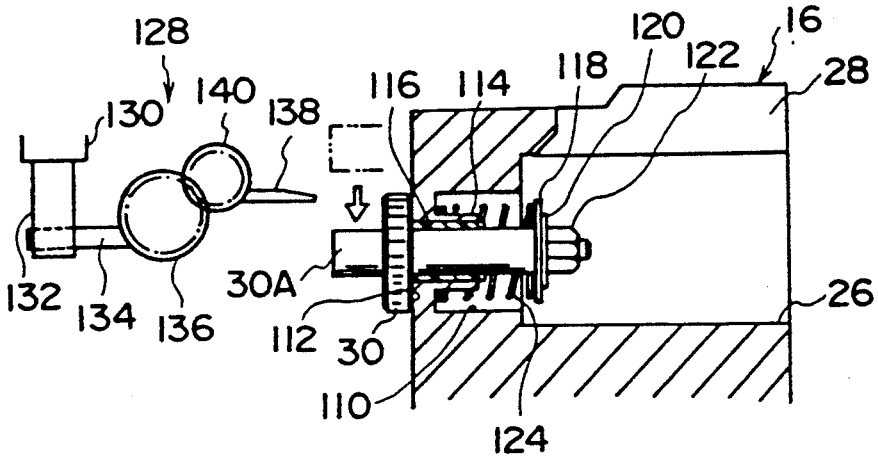
FIG. 10A is a side view illustrating a sensor position when no cartridge is detected.

As shown in FIG. 10A, a circular groove 110, whose diameter is smaller than the outer peripheral dimension of the cartridge 12, is formed in a bottom portion of the cartridge loading groove 26. A through-hole 112 is provided at a bottom portion of the circular groove 110. Peripheral portions of the through-hole 112 extend in the direction of the cartridge loading groove 26 so as to from a cylindrical portion 114 within the circular groove 110.

An intermediate portion of the shaft portion 30A is axially supported inside the cylindrical portion 114 via a collar 116. In this way, the shaft portion 30A is rotatable, as described above, and is movable in the axial direction thereof.

A male screw is formed on the end portion of the shaft portion 30A located at the cartridge loading groove 26 side, and is inserted through washers 118, 120 respectively having a larger diameter than that of the shaft portion 30A. A nut 122 screws with the male screw so as to fix the washers 118, 120.

A compression coil spring 124 is attached to the shaft portion 30A between the bottom portion of the circular groove 110 and the washer 118. The shaft portion 30A is moved axially in the direction of the cartridge loading groove 26 by the urging force of the compression coil spring 124. The amount of movement of the shaft portion 30A is limited by the abutting of the gear 30 against the bottom portion of the circular groove 110.

When there is no cartridge 12 in the cartridge loading groove 26 (the state shown in FIG. 10A), the shaft portion 30A projects into the interior of the cartridge loading groove 26. However, when the cartridge 12 is in the cartridge loading groove 26, the shaft portion 30A is moved toward the bottom portion of the circular groove 110 against the urging force of the compression coil spring 124 due to the movement of the cartridge 12 in the loading direction thereof (the state shown in FIG. 10B).

When the cartridge 12 is loaded into the cartridge loading groove 26, this loaded state is maintained by a cartridge pushing lever 126 (see FIG. 8) which will be described later.

A cartridge detecting portion 128 is disposed at the bottom portion (at the left side in FIG. 10) of the cylinder portion 16. The cartridge detecting portion 128 is formed by a bifurcated photoelectric sensor 132, which is mounted to a bracket 130, and a lever 134, which can be inserted in and withdrawn from the space between the two furcations of the photoelectric sensor 132.

The lever 134 is attached to a cogwheel 136 so as to project from the outer circumference of the cogwheel 136 in a direction tangent thereto. The lever 134 is inserted in and withdrawn from the space between the two furcations of the photoelectric sensor 132 by the rotation of the cogwheel 136. The cogwheel 136 is urged, by urging force from an unillustrated urging means, to rotate in a direction in which the lever 134 is located between the furcations. The lever 134 is thereby usually positioned so that the photoelectric sensor 132 is turned off (i.e., is in a non-continuous state).

Figure 10B:
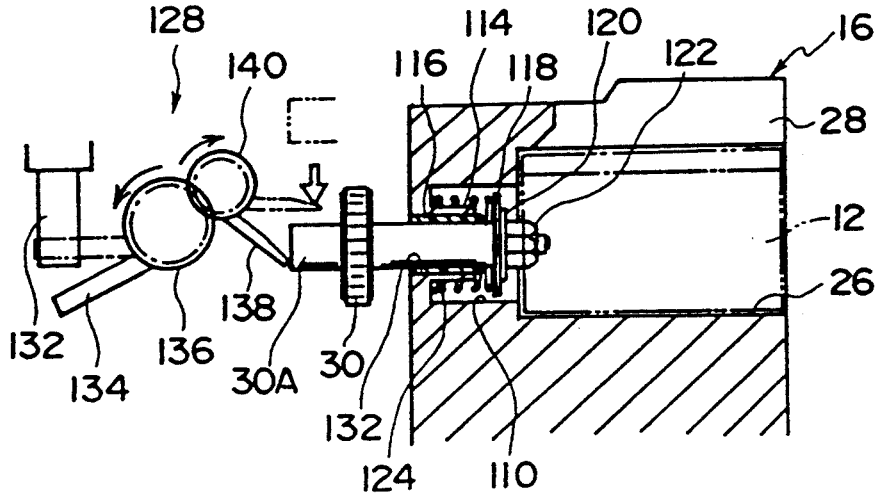
FIG. 10B is a side view illustrating a sensor position when a cartridge is detected.

The cogwheel 136 meshes with a cogwheel 140 from which a shaft portion detecting lever 138 projects in a tangential direction. The shaft portion detecting lever 138 is positioned such that the end portion thereof interferes with the shaft portion 30A when the cylinder portion 16 rotates with the cartridges accommodated therein. As a result, when the cylinder portion 16 rotates in the state illustrated in FIG. 10A, the shaft portion 30A does not abut the shaft portion detecting lever 138, and the position of the lever 134 does not change. However, when the cylinder portion 16 rotates in the state illustrated in FIG. 10B, the shaft portion 30A and the shaft portion detecting lever 138 abut so that the cogwheel 140 is rotated clockwise as shown in FIG. 10. Accordingly, the cogwheel 136 is rotated counterclockwise so that the lever 134 is withdrawn from its position between the furcations of the photoelectric sensor 132 (i.e., so that the photoelectric sensor 132 is turned on).

It can be determined from the on/off state of the photoelectric sensor 132 whether a cartridge 12 exists within the cartridge loading groove 26 which passes above the cartridge detecting portion 128.

Figure 8:
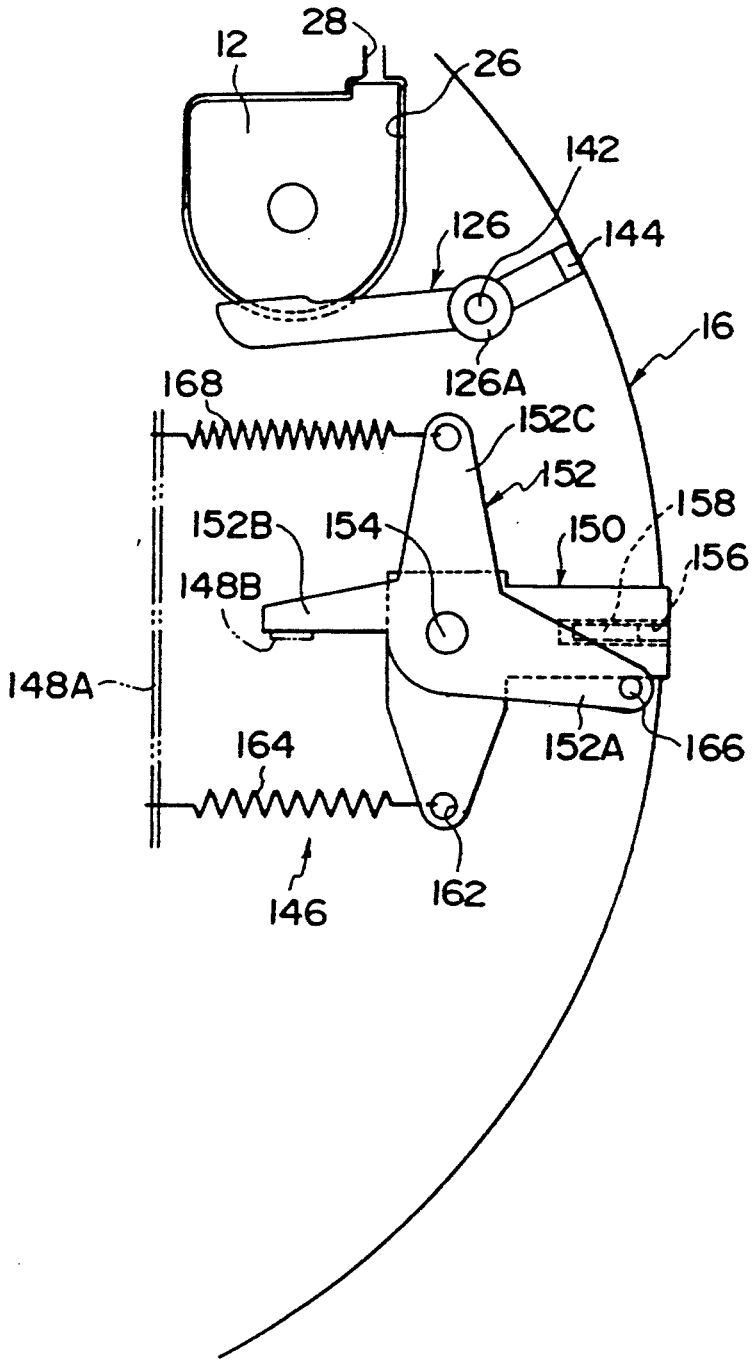
FIG. 8 is a plan view of the eject mechanism.

As illustrated in FIG. 8, the cartridge pushing lever 126 is provided for each cartridge loading groove 26. (The cartridge pushing level 126 is omitted from FIGS. 1 and 3).

The cartridge pushing lever 126 is substantially V-shaped, and a curved portion 126A thereof is axially supported to the cylinder portion 16 via a shaft 142. The shaft 142, which is axially supported to the cylinder portion 16, is rotated clockwise in FIG. 8 by the urging force of an unillustrated torsion coil spring.

One end portion of the cartridge pushing lever 126 can move above and withdraw from a position above an opening of the cartridge loading groove 26. Usually, the cartridge pushing lever 126 is positioned above the opening due to the urging force of the torsion coil spring. Therefore, by pushing the cartridge 12 accommodated in the cartridge loading groove 26 from above, the cartridge 12 can be maintained within the cartridge loading groove 26 against the urging force of the compression coil spring 124.

The other end portion of the cartridge pushing lever 126 extends to a vicinity of the outer circumference of the cylinder portion 16. At the farthest end of this end portion, a projecting portion 144 is formed so as to project perpendicular to the surface of the page in FIG. 8.

Figure 7:
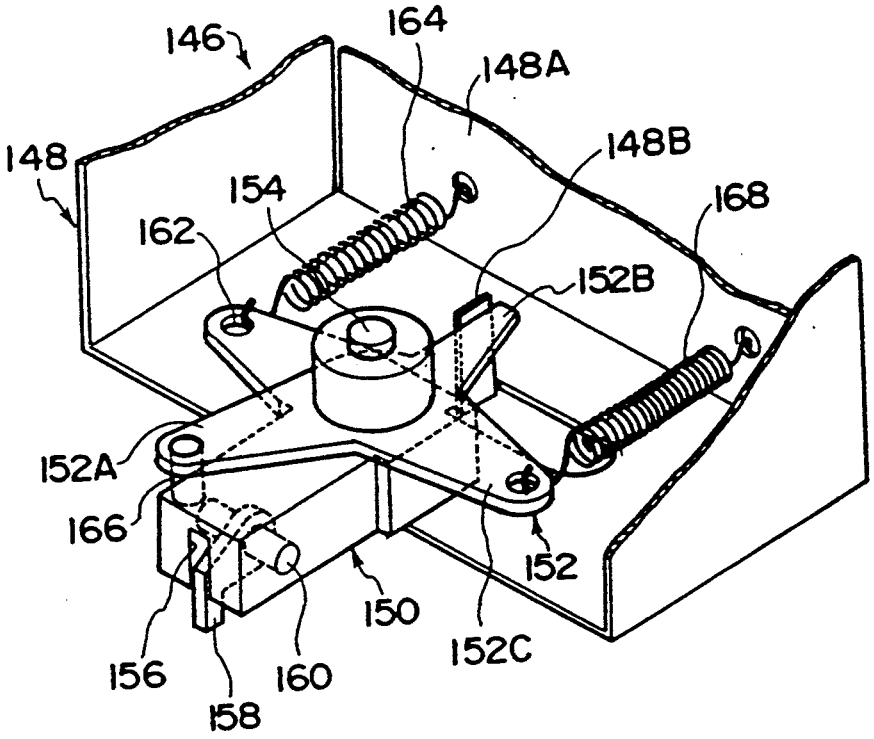
FIG. 7 is a perspective view of an eject mechanism portion for removing the cartridge from a loading groove.
Figure 9:
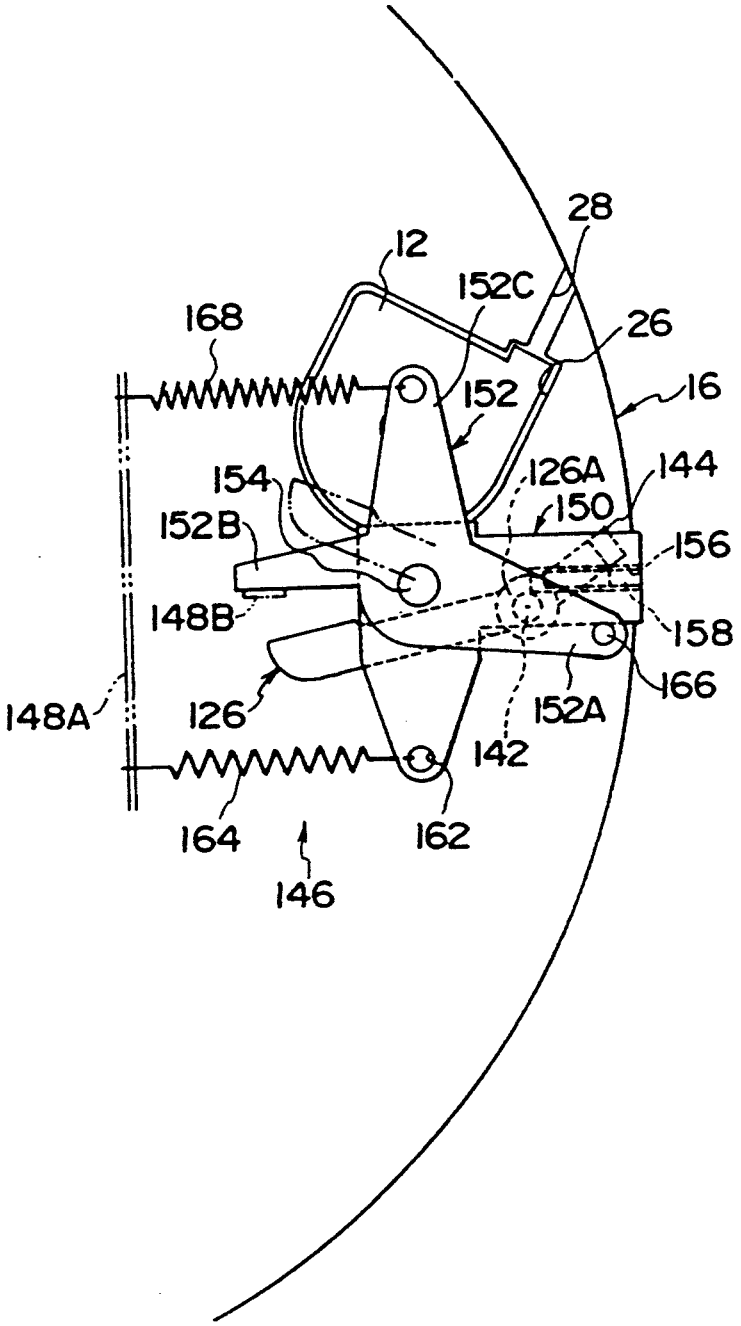
FIG. 9 is an operational view of FIG. 8.

The projecting portion 144 corresponds to a pushing releasing mechanism portion 146 illustrated in FIG. 7. As shown in FIGS. 7 through 9, the pushing releasing mechanism portion 146 is mounted via a bracket 148 to an unillustrated lid which is disposed above the cylinder portion 16.

The pushing releasing mechanism portion 146 is formed by a substantially L-shaped releasing lever 150 and a substantially Y-shaped restricting lever 152. Respective bent portions of the releasing lever 150 and the restricting lever 152 are axially supported on the same axis by a shaft 154.

A notch portion 156 is provided in a transverse direction central portion of one end portion of the releasing lever 150. A hook 158, which corresponds to the projecting portion 144 of the cartridge pushing lever 126, is accommodated in the notch portion 156. The hook 158 is axially supported to the one end portion of the releasing lever 150 by a shaft 160.

A circular hole 162 is formed in another end portion of the releasing lever 150. One end portion of a first helical tension spring 164 engages with a vertical wall portion 148A of the bracket 148. Accordingly, the releasing lever 150 is rotated clockwise in FIG. 7 around the shaft 154.

A stopper shaft 166 is attached to a first fin 152A of the restricting lever 152. The first fin 152A extends along the end portion of the releasing lever 150 to which the hook 158 is attached. The stopper shaft 166 restricts the amount by which the releasing lever 150 is rotated by the urging force of the first helical tension spring 164.

A second fin 152B extends in a direction opposite to the first fin 152A with respect to the shaft 154. The position of the stopper shaft 166 is restricted by the abutting of the second fin 152B with a stopper plate 148B, which is formed from a bent portion of the bracket 148. Further, a third fin 152C extends diametrically opposite with respect to the end portion of the releasing lever 150 to which the first helical tension spring 164 is attached. An end portion of a second helical tension spring 168 engages with the end of the third fin 152C. The urging force of the second helical tension spring 168 is set greater than that of the first helical tension spring 164.

As a result, movement of the releasing lever 150, which abuts the stopper shaft 166 due to the urging force of the first helical tension spring 164, is restricted by the urging force of the second helical tension spring 168. Rotation of the releasing lever 150 in the clockwise direction in FIG. 7 is thereby restricted.

By disposing the pushing releasing mechanism portion 146 having the above-described structure such that a cover thereof is above the cylinder portion 16, the hook 158 is disposed on the locus of movement of the protruding portion 144 of the cartridge pushing lever 126 (due to the rotation of the cylinder portion 16).

As a result, as illustrated in FIG. 8, when the protruding portion 144 and the hook 158 do not abut each other, the cartridge pusher lever 126 is above the opening of the cartridge loading groove 26. As illustrated in FIG. 9, when the cylinder portion 16 is rotated clockwise such that the protruding portion 144 and the hook 158 contact each other, the cartridge pusher lever 126 is rotated counterclockwise in FIG. 9 around the shaft 142, and the pushed state of the cartridge 12 by the cartridge pushing lever 126 can be released.

When the releasing lever 150 interfere cartridge 12 which is protruding from the cartridge loading groove 26, the releasing lever 150 rotates clockwise around the shaft 142 against the urging force of the second helical tension spring 168 so that the cartridge 12 is not damaged. Further, when the cylinder portion 16 is rotated in the opposite direction, the releasing lever 150 rotates counterclockwise around the shaft 142 against the urging force of the first helical tension spring 164 so that the pushed state of the cartridge 12 by the cartridge pushing lever 126 is maintained.

As illustrated in FIG. 1, a sprocket 32 is attached coaxially to a base portion of the supporting shaft 24. An endless belt 34 is trained around the sprocket 32 and is also trained around a sprocket 38 attached to a driving shaft 36A of a motor 36 provided adjacent to the cylinder loading portion 18. The supporting shaft 24 is rotated by the driving force of the motor 36 so that the cylinder portion 16 can be rotated.

The motor 36 is controlled to step rotate the cylinder portion 16 36° at a time. Namely, the cylinder portion 16 is rotated by angles equal to the number of degrees of one rotation of the cylinder portion 16 (360°) divided by the number of cartridges which can be accommodated. Accordingly, the positions of the cartridges 12 when the rotation of the cylinder portion 16 is stopped are the same.

A guide portion 40, which forms a conveying path of the negative film, is provided to as to correspond to a portion of the cartridge 12 at the same position. The negative film conveying path formed by the guide portion 40 corresponds with the guide path 28 formed in the cylinder portion 16. As a result, the negative film 20 is withdrawn from the cartridge 12, is guided along the guide path 28, reaches the outer circumference of the cylinder portion 16, and is delivered to the conveying path formed by the guide portion 40.

Figure 5:
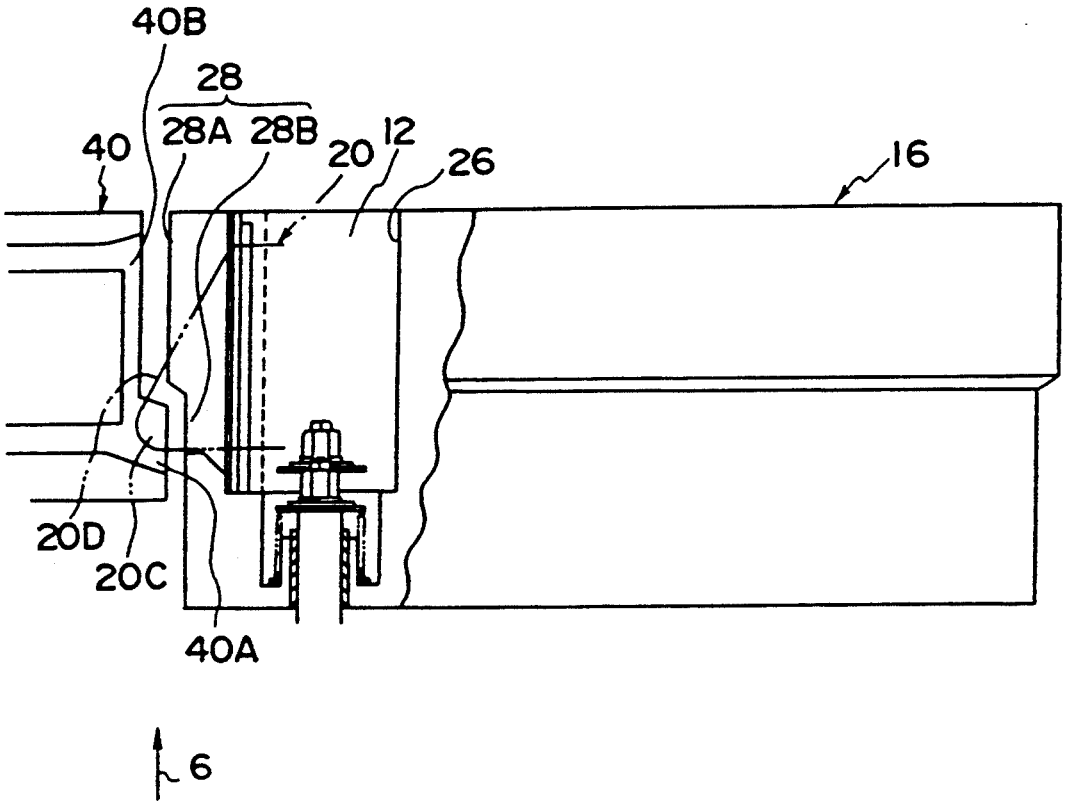
FIG. 5 is a side view illustrating a guiding structure for transferring the negative film from a cylinder portion to a guide portion.

As illustrated in FIG. 5, approximately $\frac{2}{3}$ of the upper portion of the end portion of the guide path 28 on the cylinder portion 16 side protrudes in the direction of the guide portion 40 such that the guide path 28 is stepped. (Hereinafter, the protruding portion of the guide path 28 will be referred to as the tongue portion 28A, and the lower portion which does not protrude will be referred to as the base portion 28B).

The end portion of the negative film 20, which has been withdrawn from the cartridge accommodated in the cartridge loading groove 26, is formed as a so-called diagonal-cut leader portion 20C. The leader portion 20C corresponds to the base portion 28B of the guide path 28.

A portion of the guide portion 40 which opposes the guide path 28 (i.e., approximately the lower $\frac{1}{3}$ in FIG. 5) protrudes so as to oppose the base portion 28B. The guide portion 40 is therefore stepped in the same way as the guide path 28. (Hereinafter, the protruding portion will be referred to as the tongue portion 40A, and the upper portion which does not protrude will be referred to as the base portion 40B).

The tongue portions 28A, 40A are formed respectively at such that the convex and concave portions of the guide path 28 and the guide portion 40 correspond to each other.

Figure 6:
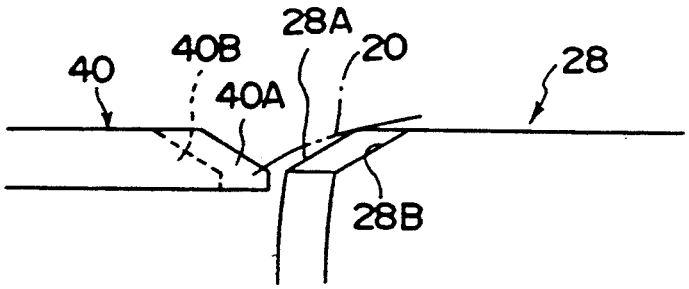
FIG. 6 is a view taken along line 6 of FIG. 5.

The tongue portion 40A and the base portion 40B of the guide portion 40 are slanted downward as shown in FIG. 6. A step is thereby formed between the base portion 28B of the guide path 28 and the tongue portion 40A of the guide portion 40.

The negative film 20 which has just been withdrawn from the cartridge 12 is tightly curled. When the negative film 20 passes over the base portion 28B, the negative film 20 is displaced in the direction of thickness (downward in FIG. 6) with respect to an ordinary conveying path.

The tongue portion 28A of the guide path 28 contacts an oblique side 20D of the leader portion 20C and functions to restrict the displacement in the direction of thickness. The tongue portion 40A of the guide portion 40 receives the leader portion 20C which first passes through the guide path 28 and functions to raise the leader portion 20C as the leader portion 20C slides along the slanted surface of the tongue portion 40A even if the leader portion 20C is tightly curled.

Namely, the negative film 20 is transferred smoothly from the guide path 28 to the guide portion 40 due to the two tongue portions 28A, 40A.

As illustrated in FIG. 4, the gear 30 of the cartridge loading groove 26, which is positioned at a position corresponding to the guide portion 40, meshes with a gear 42. The gear 42 is connected to a drive transmitting portion 44.

The gear 42 and the gear 30 mesh due to the rotation of the cylinder portion 16. When axial rotation of both the gear 42 and the gear 30 is stopped, when the gears 42, 30 are meshed, there is the fear that a shock may be imparted to the rotation of the cylinder portion 16 and that a loss of synchronism may be generated in the motor 36. Therefore, in the present embodiment, when the cylinder portion 16 rotates, the gear 42 is rotated in the negative film take-up direction by driving force from the drive transmitting portion 44. Accordingly, the meshing of the gear 42 with the gear 30 is effected smoothly, and loss of synchronism in the motor 36 is prevented.

The drive transmitting portion 44 is formed of three sprockets 46, 48, 50 and an endless belt 52 which is trained in a loop around the sprockets 46, 48, 50.

The gear 42 is fixed coaxially to the sprocket 46. Therefore, when the driving belt 52 is driven, the spool shaft 12A is rotated, and the negative film 20 can be withdrawn or taken up.

The drive transmitting portion 44 is driven by the driving force of a motor 54. A gear 56 is attached to a driving shaft 54A of the motor 54 and meshes with a gear 58A of a clutch portion 58. A substantially V-shaped lever 60 is swingably attached to the gear 58A of the clutch portion 58. Shafts 59 are respectively attached to end portions of the lever 60. Two gears 60A, 61A are attached to one of the shafts 59 in the axial direction thereof, whereas two gears 60B, 61B are attached to the other shaft 59 in the axial direction thereof. A friction member 92 is disposed between the gears 60A and 61A and between the gears 60B and 61B, respectively. The gears 60A, 60B mesh with the gear 58A of the clutch portion 58. The friction members 92 function to lower the rotational torque of the spool shaft 12 and that of a drum 78 with respect to the rotational torque of a heat roller 62 which will be described later. When a predetermined tension is applied to the negative film 20, the friction members 92 rotate gears 60A, 60B and the gears 61A, 61B relatively.

The gear 61A at one end portion of the lever 60 meshes selectively with gears 48A, 50A which are coaxially attached to the sprockets 48, 50, respectively.

The training paths of the belt 52 around the respective sprockets 48, 50 differ. When the motor 54 is rotated at the same speed, the speed at which the belt 52 is conveyed when the gear 61A and the gear 48A mesh is slower than the speed at which the belt 52 is conveyed when the gear 61A and the gear 50A mesh.

When the motor 54 is driven forward (rotation when the negative film 20 is withdrawn from the cartridge 12, i.e., clockwise rotation in FIG. 1), the lever 60 is swung counterclockwise so that the gear 61A meshes with the gear 48A (the state illustrated by the solid line in FIG. 4). On the other hand, when the motor 54 is driven backward (rotation when the negative film 20 is taken up into the cartridge 12, i.e., counterclockwise rotation in FIG. 1), the lever 60 is swung clockwise so that the gear 61A meshes with the gear 50A (the state illustrated by the imaginary line in FIG. 4).

As illustrated in FIG. 1, the heat roller 62 is disposed at the downstream side of the conveying path of the negative film formed by the guide portion 40. The heat roller 62 is divided in the axial direction thereof into two portions at which pairs of flanges 62B, 62C are respectively formed. The negative film 20 which passes along the negative film conveying path is delivered so as to contact the outer periphery of the heat roller 62 between the flanges 62B at the upper side in FIG. 4.

A heat source 62A, formed by a halogen lamp or the like, is disposed at an axially central portion of the heat roller 62. The surface of the heat roller 62 is heated by heat from the heat source 62A.

Respective portions of the outer circumferences of the two portions of the heat roller 62 respectively contact drive rollers 64, 65. A sprocket 93 is attached to one end (the lower end in FIG. 4) of the axis of rotation of the drive rollers 64, 65. An endless belt 66 is trained around the sprocket 93. The belt 66 is also trained around a sprocket 58B which is coaxially attached to the gear 58A of the clutch portion 58. The heat roller 62 is thereby driven by driving force from the motor 54.

The rotational speed of the heat roller 62 is constant so that the negative film 20 can be conveyed at a constant speed. Further, a linear velocity V of the heat roller 62 is faster than a velocity $V_1$ which is the velocity of the shaft 30A rotated via the gear 48A and which is the velocity at which the negative film 20 is conveyed from the spool shaft 12A ($V > V_1$). This difference in velocity is absorbed by the relative rotation of the gears 60A and 61A due to the friction members 92 so that the negative film 20 is conveyed while the predetermined tension thereof is maintained.

The circumferential surfaces of the drive rollers 64, 65 have relatively weak adhesion. Dirt adhering to the circumferential surface of the heat roller 62 can be removed due to the adhesion.

Respective portions of the circumferential surfaces of the drive rollers 64, 65 contact dirt removing rollers 94, 96, respectively. The circumferential surfaces of the dirt removing rollers 94, 96 have relatively high adhesion so as to remove dirt adhering to the drive rollers 64, 65 from the circumferential surface of the heat roller 62.

Namely, the dirt removing rollers 94, 96 indirectly remove dirt adhering to the circumferential surface of the heat roller 62. As viewed from above, the outer configuration of the drive rollers 64, 65 interferes with the flanges 62B, 62C of the heat roller 62, and the dirt removing rollers 94, 96 are set apart from the flanges 62B, 62C. In other words, when the dirt removing rollers 94, 96 are easily removed by being moved axially along a shaft 98 without removing other parts from the apparatus.

A temperature sensor 68 is provided in a vicinity of the drive roller 64 and detects the surface temperature of the heat roller 62. A control device 70 effects feedback control of the heat source 62A on the basis of a detected signal from the temperature sensor 68 which detects the surface temperature of the heat roller 62. The temperature of the heat roller 62 is thereby maintained at a temperature greater than or equal to the glass transition point (e.g., 70°-80° C.).

Endless belts 72 are trained around half of the outer circumference of the heat roller 62. The belts 72 are disposed in a loop shape by a plurality of rollers 74 and are driven in accordance with the rotation of the heat roller 62.

When the negative film 20 reaches the outer circumference of the heat roller 62, the negative film 20 is interposed between the heat roller 62 and the belt 72. The negative film 20 is trained around half of the circumference of the heat roller 62 so as to be conveyed in a substantially U-shaped configuration.

Further, the belt 72 prevents volatility of the moisture from the emulsion layer. If the belt 72 is smaller than the width of the film, the portions of the film which are not covered by the belt 72 contract due to evaporation, and the film deforms into a trough-like configuration. Accordingly, it is preferable that the width of the belt is slightly wider than the width of the film.

The negative film 20 is heated by being trained around the heat roller 62. Because the surface temperature of the heat roller 62 exceeds the glass transition point, curling of the negative film 20, which is caused by the negative film 20 being wound around the spool shaft 12A, is eliminated.

Figure 3:
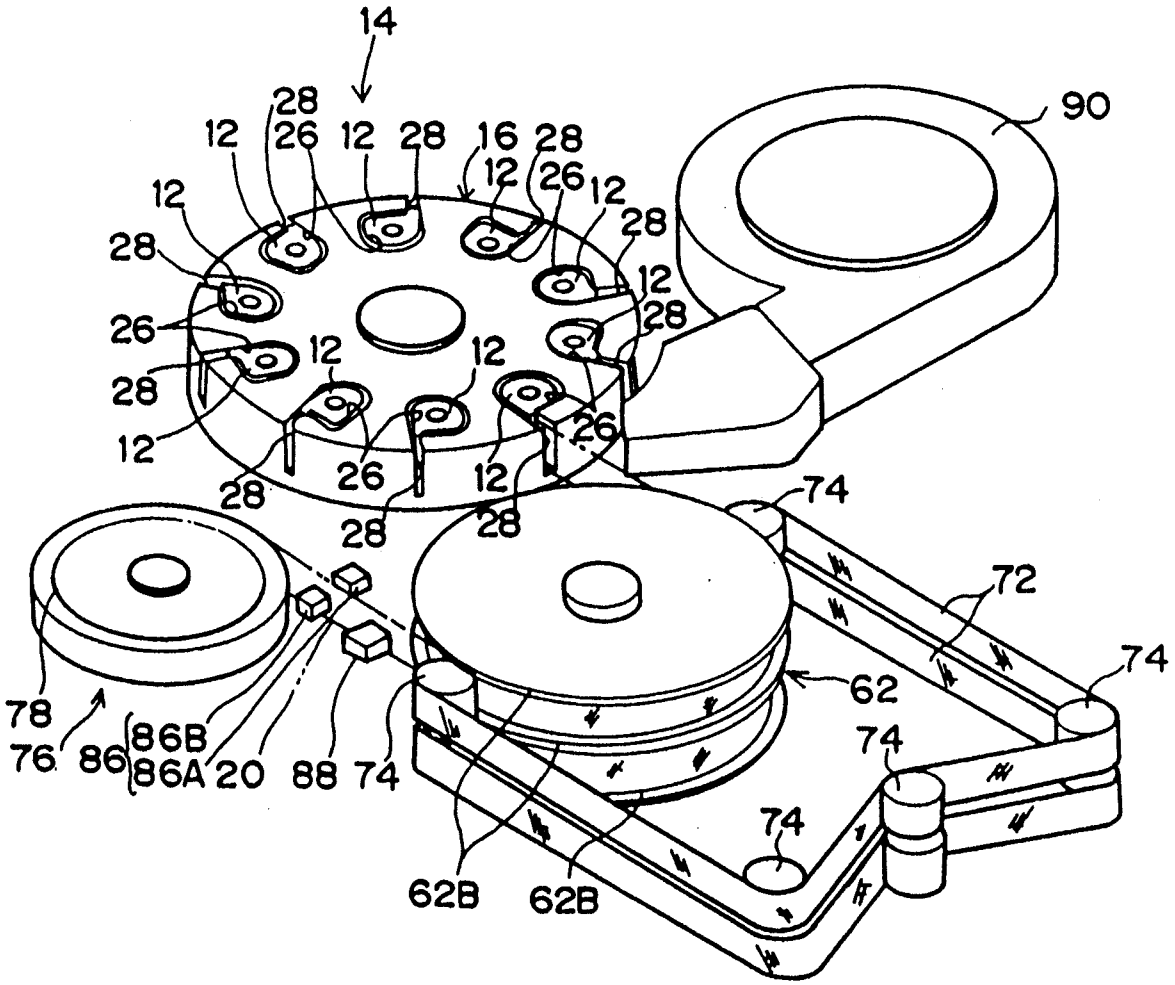
FIG. 3 is a perspective view illustrating main portions of the negative film curling correcting apparatus relating to the present embodiment.

As illustrated in FIG. 3, the belts 72 are provided as a pair. The negative film 20 is interposed between one of the belts 72 and the heat roller 62. The other belt 72 functions to reliably receive the rotating force of the heat roller 62. Accordingly, even when the negative film is interposed between the belt 72 and the heat roller 62, the belts 72 rotate as the heat roller 62 rotates.

The flanges 62B are formed on the heat roller and guide the transverse direction of the negative film 20.

A take-up section 76 is provided at a downstream side in the conveying direction of the negative film 20, which is trained around the heat roller 62 so that the conveying direction thereof is changed in a substantially U-shape. The rotatable drum 78 is disposed in the take-up section 76. The negative film 20 delivered from the heat roller 62 is taken up in the form of a roll on the outer circumference of the drum 78. A sprocket 78A is fixed coaxially to the drum 78. An endless belt 80 is trained around the sprocket 78A. The belt 80 is also trained around a pair of sprockets 82, 84. The gear 60B, which is provided at the end portion of the lever 60 of the clutch portion 58, is disposed between the pair of sprockets 82, 84. Gears 82A, 84A are attached coaxially to the sprockets 82, 84, respectively. The gear 61B selectively meshes with either of the gears 82A, 84A due to the swinging of the lever 60.

As a result, the drum 78 is rotated in directions of taking up and withdrawing of the negative film 20 in accordance with the forward rotation and the reverse rotation of the motor 54.

When the motor 54 is driven forward, a speed $V_2$ at which the negative film 20 is taken up by the drum 78, which is rotated via the gear 82, becomes faster than the linear velocity V of the heat roller 62 ($V<V_2$). The difference in the speeds is absorbed by the relative rotation between the gears 60B and 61B due to the friction members 92 so that the negative film 20 is conveyed with the predetermined tension thereof maintained. On the other hand, when the motor 54 is rotated backward, the linear velocity V of the heat roller 62 becomes faster than the speed $V_2$ at which the negative film 20 is taken up by the drum 78 rotated via the gear 82A ($V>V_2$). This difference in speed is also absorbed by the relative rotation between the gears 60B and 61B due to the friction members 92 so that the negative film 20 is conveyed while the predetermined tension thereof is maintained.

Namely, when the negative film 20 is withdrawn (i.e., when the gears 61A and 48A mesh and the gears 61B and 82B mesh), the relation between the linear velocity $V_1$ of the spool shaft 12A, the linear velocity V of the heat roller 62 and the linear velocity $V_2$ of the drum 78 is $V_1<V<V_2$. When the negative film 20 is taken up (i.e., when the gears 61A and 50A mesh and the gears 61B and 84A mesh due to the swinging of the lever 60), the relation between the linear velocity $V_1$ of the spool shaft 12A, the linear velocity V of the heat roller 62 and the linear velocity $V_2$ of the drum 78 is $V_1>V>V_2$.

Accordingly, the negative film 20 is conveyed without slack, and is conveyed with the predetermined tension thereof maintained by the relative rotation between the gears 60A and 61A and the relative rotation between the gears 60B and 61B due to the friction members 92.

A sensor 86 is disposed along the conveying path of the negative film 20 between the heat roller 62 and the take-up portion 76. A light-emitting portion 86A and a light-receiving portion 86B of the sensor 86 are disposed such that the conveying path is interposed therebetween. The sensor 86 detects the perforations 20A provided on the negative film 20. The number of detected perforations 20A is counted by the control device 70. If respective lengths of a plurality of negative films 20 are equal, the respective numbers of perforations 20A formed on each negative film 20 are also equal. Therefore, the counted value when the negative film 20 is completely withdrawn from the cartridge 12 is stored in advance, and the value is compared with the number counted by the sensor 86. In this way, it can be determined if the negative film 20 is completely withdrawn.

The rotating direction of the motor 54 is changed from forward rotation to reverse rotation due to the detection that the negative film 20 has been completely withdrawn. Due to the reverse rotation of the motor 54, the drum 78 is rotated in the clockwise direction, and the heat roller 62 is rotated in the counterclockwise direction. In this case, the negative film 20 is withdrawn from the take-up section 78 and passes along the same conveying path as that when the negative film 20 is withdrawn from the cartridge 12. The negative film 20 is thereby returned to the cartridge 12.

A magnetic head 88 is disposed along the conveying path between the heat roller 62 and the take-up section 76 so as to be closer to the heat roller 62 than the sensor 86. The magnetic head 88 can read information recorded on the magnetic recording layer 20B of the negative film 20 and/or record information onto the magnetic recording layer 20B.

Cool air from a scirocco fan 90 is blown to the conveying path between the heat roller 62 and the negative film loading section 14 (i.e., at the position where the guide portion 40 is located). The scirocco fan 90 is controlled so as to be driven only when the negative film 20 is being conveyed back to the cartridge 12. The negative film 20 heated by the heat roller 62 is returned to the cartridge 12 while being cooled by the cool air. Due to this cooling, the negative film 20 is cooled to a temperature less than or equal to the glass transition temperature of the negative film 20 (the supporting body). If the negative film 20 is not cooled to a temperature less than or equal to the glass transition temperature, the negative film 20 is curled again when accommodated in the cartridge 12.

Accordingly, the negative film 20 is accommodated within the cartridge 12 in a state in which the curling generated by the negative film 20 being trained around the heat roller 62 is maintained.

The direction in which the negative film 20 is trained onto the heat roller 62 and the direction in which the negative film 20 is taken up onto the spool shaft 12A of the cartridge 12 are reciprocal directions. Therefore, the curling of the negative film 20, which is taken up again by the spool shaft 12A, is offset by the taking up of the negative film 12 onto the spool shaft 12A.

When the processes of completely withdrawing the negative film 20 from the cartridge 12 and re-taking up the negative film 20 as described above are completed, the motor 36 is driven. The cylinder portion 16 thereby rotates 36°, and the same operations are repeated for the next cartridge 12. In this way, the curling of the negative films 20 of the ten cartridges 12 due to the spool shafts 12A is corrected. The cylinder portion 16 is removed, and the cartridges 12 are taken out therefrom and are sent to subsequent processes (e.g., developing processing, printing processing).

Operation of the present embodiment will be described hereinafter.

The cartridges 12 are loaded into each of the cartridge loading grooves 26 of the cylinder portion 16 which has been removed from the cylinder loading portion 18. At this time, the cartridge pushing lever 126 is withdrawn from its position above the opening of the cartridge loading groove 26. The shaft portion 30A is retracted against the urging force of the compression coil spring 124 so that the cartridge 12 is completely accommodated within the cartridge loading groove 26. Accordingly, by releasing the cartridge pushing lever 126 from its withdrawn state, the cartridge pushing lever 126 moves to a position above the cartridge loading groove 26 so that the loaded state of the cartridge 12 is maintained.

When the loading of the cartridges 12 into the cylinder portion 16 has been completed, the cylinder portion 16 is set in the cylinder loading portion 18. The lock lever attached to the end of the supporting shaft 24 is operated so that axial movement of the cylinder portion 16 is prevented. The loading of the cylinder portion 16 is thereby completed.

When the cylinder portion 16 is rotated, the cartridge loading grooves 26 successively reach the cartridge detecting portion 128. In the state illustrated in FIG. 10A, i.e., the state in which the cartridge 12 is not accommodated, even if the cylinder portion 16 rotates, the shaft portion detecting lever 138 does not contact the shaft portion 30A, and the position of the lever 134 does not change. Accordingly, the photoelectric sensor 132 remains on, and it is detected that there is no cartridge 12.

In the state shown in FIG. 10B, i.e., the state in which the cartridges 12 are accommodated, when the cylinder portion 16 is rotated, the shaft portion 30A contacts the shaft portion detecting lever 138, and the cogwheel 140 is rotated clockwise in FIG. 10. In accordance with the clockwise rotation of the cogwheel 140, the cogwheel 136 is rotated counterclockwise so that the lever 134 is withdrawn from its position between the two furcations of the photoelectric sensor 132 (the photoelectric sensor is off). Accordingly, it is detected that there is a cartridge 12.

When it is detected that there is no cartridge in the cartridge loading groove 26, operations of withdrawing and taking up the negative film 20 to effect curl correction therefor are canceled, and the next cartridge loading groove 26 is positioned at the predetermined position.

When a cartridge loading groove 26 in which a cartridge 12 has been detected is positioned at the predetermined position, the gear 30 and the gear 42 mesh.

At this time, because the gear 42 is rotated in the direction of taking up the negative film 20, the gear 42 can mesh smoothly with the gear 30 which approaches due to the rotation of the cylinder portion 16. Accordingly, loss of synchronism of the motor 36 of the cylinder portion 16 due to shock generated by the meshing of the gear 30 and the gear 42 can be prevented. Further, the cylinder portion 16 can be precisely rotated by predetermined angles (36°). It is preferable that the rotation of the gear 42 is slightly faster than the moving speed of the gear 30 which corresponds to the rotation of the cylinder portion 16.

In this state, when the motor 54 is driven forward, the lever 60 of the clutch portion 58 is swung counterclockwise, and the gear 61A and the gear 48A mesh. Accordingly, the driving force of the motor 54 is transmitted to the gears 42, 30 via the sprockets 46, 48, 50 and the belt 52 so that the spool shaft 12A is rotated at a low speed (linear velocity $V_1$) in the direction of withdrawing the negative film.

The negative film 20 is withdrawn from the cartridge 12, is guided to the guide portion 40, and contacts the outer circumference of the heat roller 62. At this time, the scirocco fan 90 is not operated.

When the negative film 20 is transferred from the guide path 28 to the guide portion 40, the negative film 20 is tightly curled, and a force works to displace the negative film 20 in the direction of entering the gap between the guide path 28 and the guide portion 40 (i.e., in the direction of thickness).

However, in the present embodiment, because the tongue portion 28A is formed at the guide path 28, the oblique side 20D of the leader portion 20C slidingly contacts the tongue portion 28A. Because the above-mentioned displacement is restricted, the amount of displacement is decreased.

The end of the leader portion 20C, for which the amount of displacement has been decreased, passes over the base portion 28B of the guide path 28 with a slight displacement. Thereafter, the end of the leader portion 20C moves at a downward slant, as illustrated in FIG. 6. However, the tongue portion 40A of the guide portion 40 extends on the locus of movement of the leader portion 20C and is formed as an inclined surface. Therefore, the end of the leader portion 20C abuts the tongue portion 40A and slides upwardly along the inclined surface. The negative film 20 is prevented from falling off of the guide path 28 and the guide portion 40, and can be smoothly transferred from the guide path 28 to the guide portion 40.

Driving force is transmitted to the heat roller 62 from the forward rotation of the motor 54 via the belt 66. The heat roller 62 is rotated clockwise as seen in FIG. 1 (at linear velocity V).

The negative film 20 which reaches the outer circumference of the heat roller 62 is guided between the outer circumference of the heat roller 62 and the belt 72 so as to be interposed therebetween. The negative film 20 is trained around half of the circumference of the heat roller 62 while contacting the outer circumference thereof.

Because the flanges 62B are provided on the heat roller 62, the negative film 20 is trained linearly around the heat roller 62 without being skewed thereon.

The belts 72 are provided as a pair, and each is independently trained around the heat roller 62. Therefore, even if the negative film 20 is interposed between the heat roller 62 and one of the belts 72, contact of the other belt 72 with the heat roller 62 is maintained. Accordingly, the belt 72 can reliably receive the driving force of the heat roller 62 so as to be driven thereby.

The relation between the linear velocity $V_1$ of the negative film 20 withdrawn from the spool shaft 12A and the linear velocity V of the negative film 20 trained around the heat roller 62 is $V_1 < V$. Slack is not generated, and much tension is applied to the negative film 20. However, in the present embodiment, because the friction member 92 is interposed between the gear 60A and the gear 61A, the difference in velocities is absorbed by the friction member 92, and the negative film 20 is conveyed while the predetermined tension thereof is maintained.

The surface temperature of the heat roller 62 is detected by the temperature sensor 68 and is maintained at a temperature greater than or equal to the glass transition point (70°–80° C.) by feedback correction (i.e., the heat source 62A is turned on and off). Because the surface temperature exceeds the glass transition point, curling of the negative film 20 caused by the spool shaft 12A is eliminated by the training of the negative film 20 around the heat roller 62.

The perforations 20A of the negative film 20, which is conveyed by the heat roller 62 in a substantially U-shape and is delivered, are detected by the sensor 86. A detection signal from the sensor 86 is supplied to the control device 70 in which the number of detected perforations 20A are counted.

The magnetic head 88 is provided in a vicinity of the sensor 86. Therefore, as the negative film 20 is being conveyed, information recorded on the magnetic recording layer 20B of the negative film 20 can be read or new information can be recorded.

The negative film 20, whose perforations 20A are counted while the negative film 20 is being conveyed, is taken up once onto the drum 78 of the take-up portion 76, and is temporarily stored. Because the gear 61B and the gear 82A are meshed, the drum 78 is rotated at a linear velocity $V_2$ which is faster than the linear velocity V of the heat roller 62 via the gears 60B, 61B at the ends of the lever 60 due to the driving force of the motor 54 ($V < V_2$). Accordingly, the negative film 20 is conveyed without slack, and much tension is applied thereto. However, in the present embodiment, because the friction member 92 is disposed between the gear 60B and the gear 61B, the difference in velocities is absorbed by the friction member 92. The negative film 20 is thereby conveyed while the predetermined tension thereof is maintained, and is wound around the drum 78.

When a determination is made by the control device 70 that the counted number of perforations 20A has reached the value determined in advance, it is understood that the negative film 20 has been completely withdrawn from the cartridge 12, and the rotating direction of the motor 54 is reversed from forward rotation to reverse rotation. By the reverse rotation of the motor 54, the drum 78 is rotated clockwise, the heat roller 62 is rotated counterclockwise, and the spool shaft 12A is rotated in the direction of taking up the negative film 20. Further, the lever 60 is swung so that the gears 61A and 50A mesh and the gears 61B and 84A mesh. Accordingly, the linear velocity $V_2$ of the drum 78 becomes a low speed ($V > V_2$), and the linear velocity $V_1$ of the spool shaft 12A becomes a high speed ($V < V_1$). Further, the negative film 20 may be conveyed more quickly when the negative film 20 is unwound from the drum 78 as compared to when the negative film 20 is wound thereon.

The negative film 20 is unwound from the drum 78 of the take-up portion 76 while the predetermined tension thereof is maintained. The negative film 20 is again guided to the outer circumference of the heat roller 62, and is trained around half of the circumference of the heat roller 62 while interposed between the heat roller 62 and the belt 72. The negative film 20 is conveyed through the guide portion 40 and is taken up onto the spool shaft 12A of the cartridge 12 at a predetermined tension.

When the negative film 20 is rewound, the sirocco fan 90 is driven, and cool air is blown on the negative film 20 passing through the guide portion 40. As a result, the negative film 20 is taken up onto the spool shaft 12A within the cartridge 12 while retaining the curl generated by the negative film 20 being trained around the heat roller 62. However, because the curl generated by the spool shaft 12A and the curl generated by the heat roller 62 are in reciprocal directions, the curling of the negative film 20 is offset by the negative film 20 being taken up by the spool shaft 12A.

When the withdrawing and re-taking up of the negative film 20 into the cartridge 12 are completed, the motor 36 is driven, and the cylinder portion 16 rotates 36°. Accordingly, the next cartridge 12 corresponds to the guide portion 40, and the same process are repeated for the subsequent 9 cartridges.

Due to the rotation of the cylinder portion 16, the cartridge loading groove 26, in which a cartridge 12 which has undergone curling correction processing is accommodated, reaches the position at which the pushing releasing mechanism portion 146 is disposed.

As the cylinder portion 16 rotates from the state illustrated in FIG. 8, the protruding portion 144 and the hook 158 gradually approach each other. When the protruding portion 144 and the hook 158 contact, the cartridge pusher lever 126 rotates counterclockwise in FIG. 9 around the shaft 142 so that the pushed state of the cartridge 12 can be released.

When the pushed state of the cartridge 12 by the cartridge pusher lever 126 is released, the cartridge 12 is protruded by the urging force of the compression coil spring 124 attached to the shaft portion 30A. Therefore, the cartridges which have not yet been processed and those which have can be readily distinguished.

The cartridges 12 which have been protruded from the cartridge loading grooves 26 also contact the hook 158 due to the rotation of the cylinder portion 16. However, when the hook 158 is contacted by the cartridge 12 which has been protruded from the cartridge loading groove 26, the releasing lever 150 rotates clockwise around the shaft 142 against the urging force of the second helical tension spring 168. Damage to the cartridge 12 or the hook 158 can thereby be avoided.

Further, curling correction processing is effected in regular loading order. However, when there is a cartridge for which rush processing is desired, the cylinder portion 16 is rotated reversely. Then, the cartridge 12 which necessitates urgent processing is loaded into the cartridge loading groove 26 positioned at the predetermined position. In this way, rapid processing can be effected. The hook 158 and the protruding portion 144 may contact each other during this reverse rotation as well. However, when the cylinder portion 16 is rotated reversely, the releasing lever 150 is rotated counterclockwise around the shaft 142 against the urging force of the first helical tension spring 164 so that the pushed state of the cartridge 12 by the cartridge pushing lever 126 is maintained. Accordingly, the unprocessed cartridge is not protruded from the cartridge loading groove 26.

When the withdrawing and rewinding of the ten negative films 20 has been completed, the cylinder portion 16 is removed from the cylinder loading portion 18, and the cartridges 12 are taken out therefrom. The removed cartridges 12 are transported in a short time to a subsequent process (for example, developing processing or printing processing). When the negative film 20 is removed in order to undergo the various processes, it can be processed in a state in which it does not retain any curl from the spool shaft 12A. In particular, because there is no great curl at the trailing end portion, there are no drawbacks such as uneven developing processing or the like. Further, because there is no great curl at the leading end portion as well, the negative film 20 can be conveyed stably.

The dirt which the negative film 12 carries and the dust within the apparatus often stick to the heat roller 62 and may damage the negative film 12 or result in the inability to effect stable heating processing. Because the drive rollers 64, 65 have relatively low adhesion, the dirt and dust can be removed thereby. Further, the circumferential surfaces of the drive rollers 64, 65 contact the dirt removing rollers 94, 96 which have relatively high adhesion. The dirt removed from the circumferential surface of the heat roller 62 by the drive rollers 64, 65 adheres to the dirt removing rollers 94, 96. Accordingly, dirt and dust is removed from the drive rollers 64, 65 so that the adhesion thereof can always be maintained.

The dirt removing rollers 94, 96 must be changed when a predetermined amount of dirt and the like has adhered thereto. As viewed from above, the outer configuration of the dirt removing rollers 94, 96 is distanced from the flanges 62B, 62C of the heat roller 62. Therefore, even if the dirt removing rollers 94, 96 are moved axially along the shaft 98, the dirt removing rollers 94, 96 can be easily removed without any interfering members.

In the present embodiment, the apparatus for correcting the curling of the negative film 20 is provided separately from the developing apparatus and the printing apparatus. Therefore, the negative film 20 can undergo curl correction after having been photographed and before being developed. The negative film 20 can also undergo curl correction before being reprinted.

Further, ten cartridges 12 are loaded at one time, and operations are effected automatically until curling correction for all of the loaded cartridges 12 is completed. Therefore, even if this new work process is added, there is no great loss in work efficiency. On the contrary, the efficiency improves compares to negative films which are subject to developing processing or printing processing while curled.

Moreover, the linear velocity of the negative film 20 is fast at the upstream side so that slack is eliminated, and the predetermined tension is maintained by the absorption by the friction members 92. Therefore, the negative film 20 is conveyed in accordance with the linear velocity of the heat roller 62 which has high torque. The heating of the negative film 20 by the heat roller 62 is therefore constant from the leading end to the trailing end of the negative film 20.

Because the negative film 20 is heated uniformly, the slight damage (change in density and the like) caused by heating is imparted uniformly to the entire negative film 20. Therefore, there is no problem in actuality.

Further, with respect to the removal of dirt from the circumferential surface of the heat roller 62, the drive rollers 64, 65, which directly contact the heat roller 62, have low adhesion and contact the dirt removing rollers 94, 96 which have high adhesion. Therefore, when the dirt removing rollers 94, 96 are to be changed, they can be easily removed as nothing interferes with locus of movement in the axial direction thereof.

Moreover, in the present embodiment, ten cartridges 12 are loaded into the cylinder portion 16 at one time and are processed automatically. However, the cartridges 12 may be directly placed one at a time in a vicinity of the guide portion 40.

Figure 11:
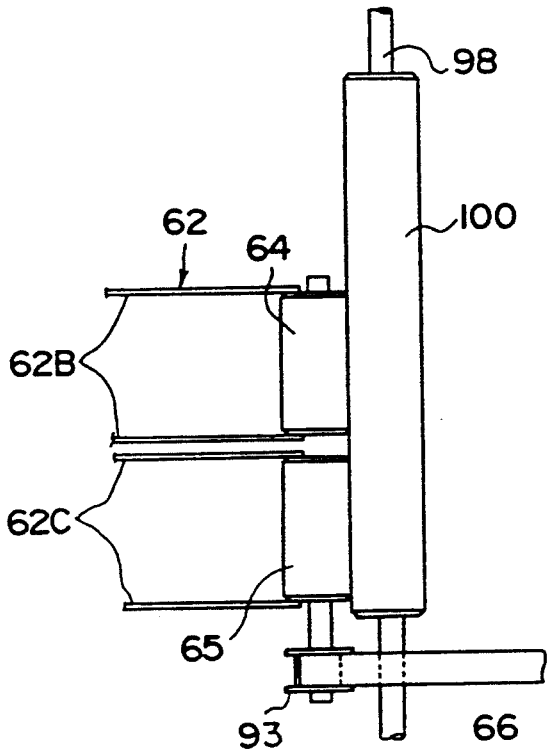
FIG. 11 is a side view of a case in which an elongated roller is used to remove dirt from drive rollers.

In the present embodiment, the dirt removing rollers 94, 96 are disposed so as to correspond respectively to the drive rollers 64, 65 in order to remove dirt and the like therefrom. However, as illustrated in FIG. 11, the drive rollers 64, 65 may contact one elongated roller 100 whose position of contacting the drive rollers 64, 65 may be changed by periodically moving the elongated roller 100 in the axial direction thereof. In this way, the roller 100 can be changed less frequently.

Figure 12:
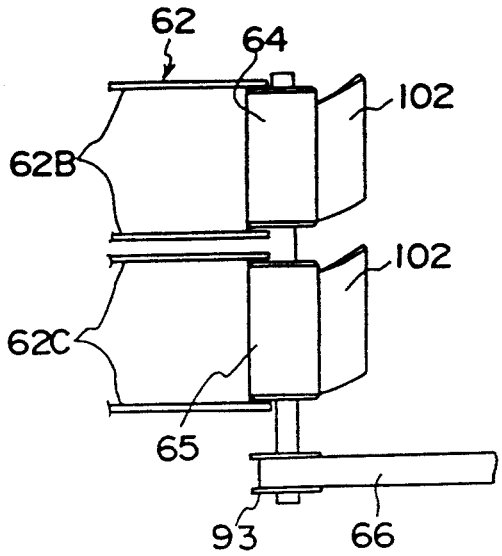
FIG. 12 is a side view of a case in which scrapers are used to remove dirt from the drive rollers.
Figure 13:
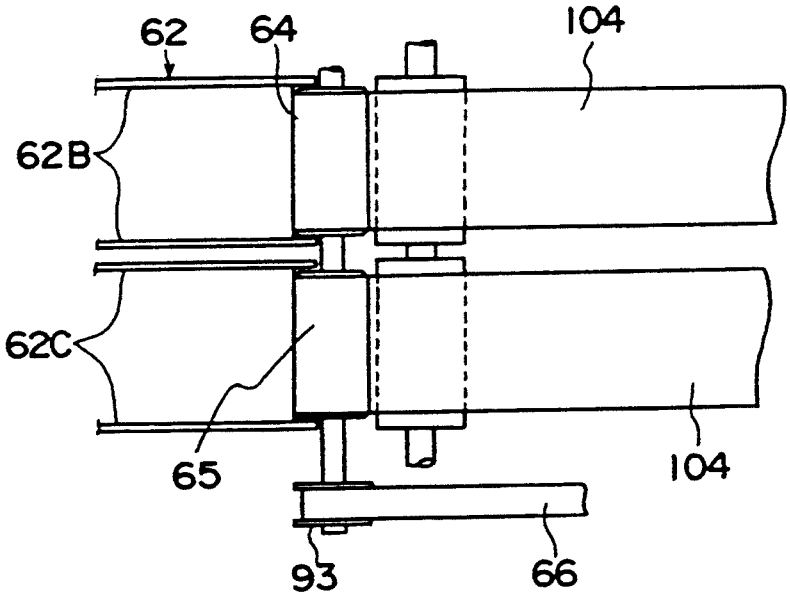
FIG. 13 is a side view of a case in which belts are used to remove dirt from the drive rollers.

As illustrated in FIG. 12, scrapers 102 may be provided. The scrapers 102 contact the drive rollers 64. 65 so as to scrape off dirt and the like adhering thereto. Further, as shown in FIG. 13, belts 104 which have high adhesion may be driven in accordance with the rotation of the drive rollers 64, 65.

Figure 14:
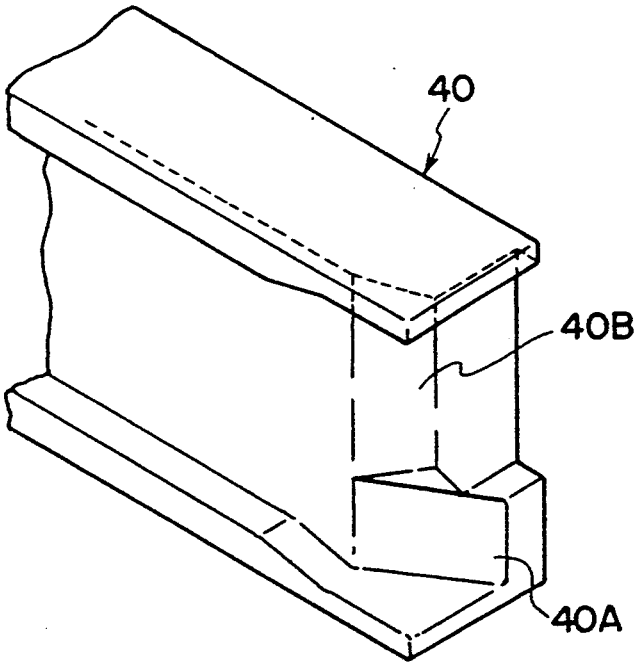
FIG. 14 is a perspective view illustrating a variation in which an angle of an inclined surface of a tongue portion of a guide portion is made small.

In the present embodiment, the tongue portion 28A and the tongue portion 40A are provided at the guide path 28 and the guide portion 40, respectively. The curling of the leader portion 20C of the negative film 20 is reduced by the tongue portion 28A of the guide path 28, and the leader portion 20C is guided smoothly by the tongue portion 40A of the guide portion 40. However, as illustrated in FIG. 14, the tongue portion 40A of the guide portion 40 may be inclined in the same direction as the base portion 40B at an angle smaller than the angle of the inclined surface of the base portion 40B.

Figure 15:
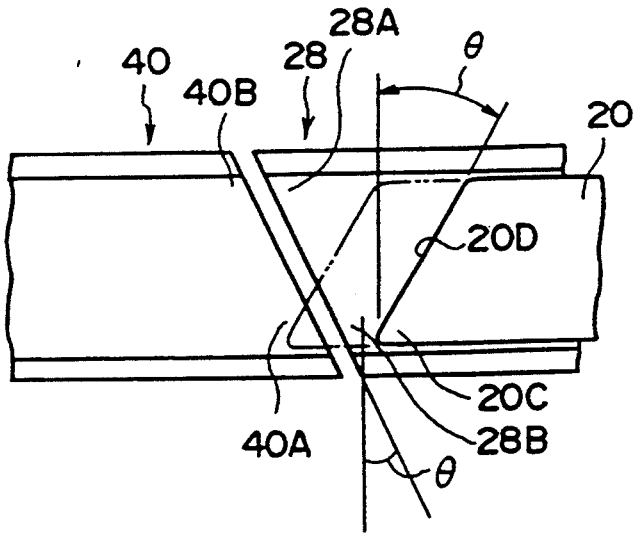
FIG. 15 is a side view illustrating a variation in which opposing surfaces of the guide portion and a guide path are inclined along a transverse direction of the negative film.

Further, as illustrated in FIG. 15, the opposing surfaces of the guide path 28 and the guide portion 40 may each be formed as a surface inclined at an angle $\theta$ which corresponds to the angle $\theta$ of the oblique side 20D of the leader portion 20C of the negative film 20. Here, if the edge of the guide portion 40 is set lower, in the direction of curling, than the edge of the guide path 28 (i.e., towards the rear of the page in FIG. 15), the negative film 20 is transferred even more smoothly.

Figure 16:
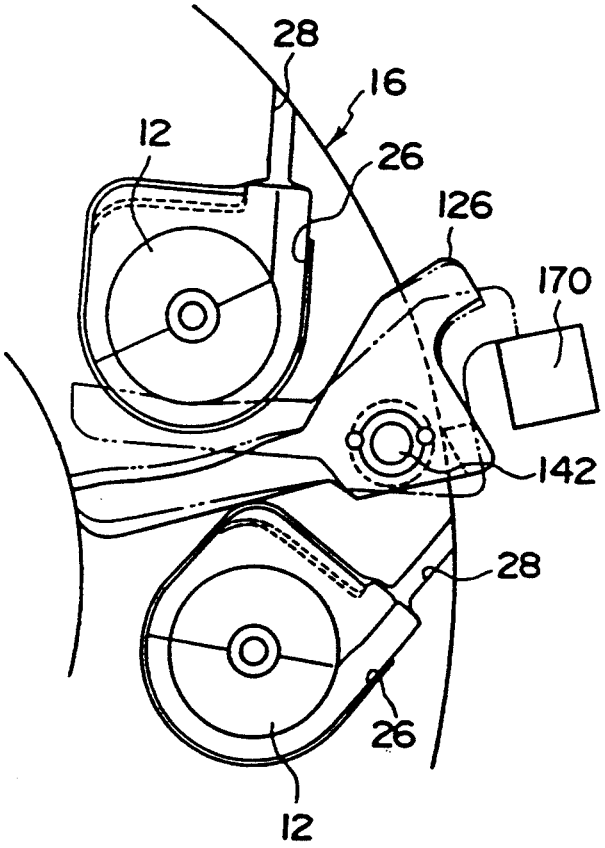
FIG. 16 is a plan view illustrating a variation of a pushing releasing mechanism portion.

In the present embodiment, the pushing releasing mechanism portion 146, which releases the cartridge 12 from the state of being accommodated and held within the cartridge loading groove 26, is disposed above the cylinder portion 16. However, as illustrated in FIG. 16, a releasing lever 170 may be disposed in the radial direction of the cylinder portion 16.

Further, in the present embodiment, the surface temperature of the heat roller 62 is maintained constant (70°-80° C.). However, because the curling of the negative film 20 is particularly strong at the trailing end portion thereof, if the surface temperature is set low and is controlled to be the highest when the trailing end portion is trained around the heat roller 62, even more uniform curling correction can be effected.

It is possible for the negative film 20 to be conveyed slowly while being withdrawn from the cartridge 12 and quickly while being taken up into the cartridge 12. In addition, the speed of the negative film 12 can be controlled such that the negative film 12 is conveyed quickly when first withdrawn and the conveying velocity thereof gradually decreases thereafter. In this way, even if the surface temperature of the heat roller 62 is constant, more heat can be applied to the trailing end portion of the negative film 20, and heat can be applied in accordance with the strength of the curl.

In the present embodiment, the negative films 20 after developing processing are completely withdrawn from the cartridges 12. However, it suffices that only the leading end portions of negative films 20 after developing processing are trained around the heat roller 62, undergo curling correction, and are immediately rewound into the cartridge. Accordingly, when the negative film 20 is sent to a negative carrier during printing processing, the negative film 20 can be stably conveyed, and the image surface is not effected by overheating. As a means of determining whether a negative film has been subject to developing processing or not, an operator may make a visual determination and manually switch a switch or the like. Alternatively, because the base density is extremely different before and after developing processing, an automatic determination may be made as to whether a negative film has been subject to developing processing by detecting the density thereof.

What is claimed is:

1. A photographic film curling correcting method for correcting curling of photographic film generated when said photographic film is stored for a long time in a cartridge in which said photographic film is taken up around a shaft in a form of a roll and is accommodated, comprising the steps of:

curvilinearly conveying said photographic film which is withdrawn from said cartridge, around a heat roller so that the curling of said photographic film generated by taking up of said photographic film around said shaft takes on an opposite direction; and relaxing the curling by heating said photographic film with said heat roller while said photographic film is being curvilinearly conveyed around said heat roller, and taking up said photographic film, whose curling has been relaxed, into said cartridge again while cooling said photographic film.

2. A photographic film curling correcting apparatus for correcting curling of photographic film generated when said photographic film is stored for a long time in a cartridge in which said photographic film is taken up around a shaft in a form of a roll and is accommodated, comprising:

a loading portion in which said cartridge is loaded;

conveying means for conveying said photographic film from said cartridge, which is loaded in said loading portion, in one of a direction of withdrawing said photographic film and a direction of taking up said photographic film;

withdrawing control means for controlling said conveying means and withdrawing said photographic film from said cartridge;

a heat roller around which said photographic film withdrawn from said cartridge is trained in a direction opposite to the direction of taking up said photographic film onto said shaft, a surface of said heat roller being heated by a heating means so that said heat roller heats said trained photographic film;

an accommodating portion for temporarily accommodating said photographic film heated by said heat roller;

detecting means for detecting that said photographic film has been completely withdrawn from said cartridge;

taking up control means for controlling said conveying means to reversely convey said photographic film from said accommodating portion along a same conveying path and for taking up said photographic film into said cartridge again when said detecting means detects that said photographic film has been completely withdrawn; and, cooling means for cooling said photographic film when said photographic film is taken up by said taking up control means.

3. A photographic film curling correcting apparatus according to claim 2, wherein said heat roller applies a temperature exceeding glass transition temperature to said photographic film.

4. A photographic film curling correcting apparatus according to claim 2, wherein a surface temperature of said heat roller is raised from a time when a leading end portion, in the direction of withdrawing, of said photographic film is trained around said heat roller to a time when a trailing end portion is trained around said heat roller.

5. A photographic film curling correcting apparatus according to claim 2, wherein when said photographic film is withdrawn from said cartridge by said conveying means, said photographic film is conveyed at high speed at a leading end portion thereof, and a conveying speed decreases in accordance with an approaching of a trailing end portion.

6. A photographic film curling correcting apparatus according to claim 2, wherein when said photographic film is withdrawn from said cartridge by said conveying means, said conveying means conveys said photographic film at low speed, and when said photographic film is taken up into said cartridge, said conveying means conveys said photographic film at high speed.

7. A photographic film curling correcting apparatus for correcting curling of photographic film generated when said photographic film is stored for a long time in a cartridge in which said photographic film is taken up around a shaft in a form of a roll and is accommodated, comprising:

a loading portion in which said cartridge is loaded;

a heat roller whose surface is heated by a heating means, and which corrects curling of said photographic film;

conveying means for completely withdrawing and taking up said photographic film when said photographic film has not been subject to developing processing, and for withdrawing and taking up only a leading end portion, upon which images are not printed when said photographic film has been subject to developing processing, when said photographic film is taken up again into said cartridge after having been withdrawn from said cartridge loaded in said loading portion and having been trained around said heat roller in a direction opposite to a direction of taking up said photographic film onto said shaft; and, cooling means for cooling said photographic film when said photographic film is taken up by said conveying means.

8. A photographic film curling correcting apparatus for correcting curling of photographic film generated when said photographic film is stored in a cartridge in which said photographic film is taken up around a spool shaft in a form of a roll and is accommodated, said photographic film having a leader portion whose leading edge is cut obliquely from one transverse direction end thereof to another transverse direction end thereof, said photographic film curling correcting apparatus comprising:

a loading portion in which said cartridge is loaded;

a first guide path guiding said photographic film withdrawn from said cartridge loaded in said loading portion, a continuous or intermittent first stepped portion being formed from a side towards a leadingmost edge of said leader portion and along a transverse direction of said photographic film at a leading edge, in a conveying direction of said photographic film, of said first guide path;

a heat roller around which said photographic film is trained in a direction opposite to a direction of taking up said photographic film into said cartridge, a surface of said heat roller being heated by said heating means so that said heat roller heats said trained photographic film; and a second guide path guiding said photographic film, which is transferred from said first guide path, to said heat roller, a continuous or intermittent second stepped portion being formed at an edge of said second guide path which opposes said first guide path so that convex and concave portions of said second stepped portion and said first stepped portion of said first guide path correspond to each other.

9. A photographic film curling correcting apparatus according to claim 8, wherein said second stepped portion of said second guide path is formed by a base portion and a protruding tongue portion, an inclined surface being formed at said tongue portion in a direction of thickness of said photographic film.

10. A photographic film curling correcting apparatus according to claim 9, wherein an inclined surface is formed at said base portion in the direction of thickness of said photographic film, an angle of the inclined surface of said tongue portion being greater than an angle of the inclined surface of said base portion.

11. A photographic film curling correcting apparatus in which a photographic film, which is accommodated in a cartridge in a state in which said photographic film is taken up around a spool shaft in a form of a roll, is withdrawn by a driving means, said photographic film is heated while curved in a direction opposite to a direction of curling generated by said photographic film being taken up around said spool shaft, and said photographic film curling correcting apparatus corrects the curling of said photographic film, and thereafter, said photographic film is accommodated in said cartridge again, said photographic film curling correcting apparatus comprising:

a loading portion provided with a plurality of loading grooves in which said cartridges are loaded, and moving said loading grooves successively to a photographic film withdrawing position;

a driving shaft protruding from a bottom portion of said loading groove into said loading groove, said driving shaft being provided with a shaft portion engageable with said spool shaft of said cartridge and being provided with a gear attached to said shaft portion and receiving driving force from said driving means so as to rotate, said driving shaft being movable in an axial direction thereof;

urging means for urging said driving shaft to move axially in a direction of said loading groove;

retaining means for retaining said cartridge when said cartridge is accommodated in said loading groove and said shaft portion of said driving shaft is moved axially against urging force of said urging means; and, releasing means for releasing said cartridge, for which curling correction processing has been completed, from being retained by said retaining means in accordance with positioning movement of said loading portion.

12. A photographic film curling correcting apparatus in which a photographic film, which is accommodated in a cartridge in a state in which said photographic film is taken up around a spool shaft in a form of a roll, is withdrawn by a driving means, said photographic film is heated while curved in a direction opposite to a direction of curling generated by said photographic film being taken up around said spool shaft, and said photographic film curling correcting apparatus corrects the curling of said photographic film, and thereafter, said photographic film is accommodated in said cartridge again, said photographic film curling correcting apparatus comprising:

a loading portion provided with a plurality of loading grooves in which said cartridges are loaded, and moving said loading grooves successively to a photographic film withdrawing position;

a driving shaft protruding from a bottom portion of said loading groove into said loading groove, said driving shaft being provided with a shaft portion engageable with said spool shaft of said cartridge and being provided with a gear attached to said shaft portion and receiving driving force from said driving means so as to rotate, said driving shaft being movable in an axial direction thereof;

urging means for urging said driving shaft to move axially in a direction of said loading groove;

a sensor detecting existence of said cartridge in said loading groove by detecting an axial direction position of said driving shaft; and, driving controlling means for controlling driving by said driving means to withdraw said photographic film based on results of detection of said sensor.

13. A photographic film curling correcting apparatus in which a photographic film, which is accommodated in a cartridge in a state in which said photographic film is taken up around a spool shaft in a form of a roll, is withdrawn by a driving means, said photographic film is heated while curved in a direction opposite to a direction of curling generated by said photographic film being taken up around said spool shaft, and said photographic film curling correcting apparatus corrects the curling of said photographic film, and thereafter, said photographic film is accommodated in said cartridge again, said photographic film curling correcting apparatus comprising:

a loading portion provided with a plurality of loading grooves in which said cartridges are loaded, and moving said loading grooves successively to a photographic film withdrawing position;

a driving shaft protruding from a bottom portion of said loading groove into said loading groove, said driving shaft being provided with a shaft portion engageable with said spool shaft of said cartridge and being provided with a gear attached to said shaft portion and receiving driving force from said driving means so as to rotate, said driving shaft being movable in an axial direction thereof;

rotation controlling means for rotating a gear of said driving means, which meshes with said gear when said loading portion is moving so as to position said loading grooves of said loading portion, temporarily along a direction of movement of said loading portion.

14. A photographic film curling correcting apparatus for correcting curling of a photographic film generated when said photographic film is stored in a cartridge in which said photographic film is taken up around a spool shaft in a form of a roll and is accommodated, comprising:

a loading portion in which said cartridge is loaded;

a heat roller around which said photographic film is trained in a direction opposite to a direction in which said photographic film is taken up into said cartridge, a surface of said heat roller being heated by a heating means so that said trained photographic film is heated, flanges being formed on said heat roller in a direction of thickness of said heat roller, said photographic film withdrawn from said cartridge loaded in said loading portion being guided between said flanges;

a first roller, a portion of said first roller being accommodated in said flanges of said heat roller so as to contact a circumferential surface of said heat roller, said first roller having adhesion so that dirt clinging to said circumferential surface adheres to said first roller; and, dirt removing means disposed at a position other than between said flanges for removing dirt adhering to said first roller.

15. A photographic film curling correcting apparatus according to claim 14, wherein said dirt removing means is formed by a second roller which contacts a circumferential surface of said first roller and which has adhesion higher than the adhesion of said first roller, said second roller being removed by being moved in an axial direction thereof.

16. A photographic film curling correcting apparatus for correcting curling of a photographic film generated when said photographic film is stored for a long time in a cartridge in which said photographic film is taken up around a spool shaft in a form of a roll and is accommodated, comprising:

a loading portion in which said cartridge is loaded;

a heat roller around which said photographic film withdrawn from a said cartridge is trained in a direction opposite to a direction in which said photographic film is taken up onto said spool shaft, a surface of said heat roller being heated by a heating means so that said heat roller heats said trained photographic film;

an accommodating portion taking up said photographic film heated by said heat roller onto a take-up shaft and accommodating said heat roller;

conveying means for rotating said heat roller at a predetermined rotational speed and for conveying said photographic film at a constant speed from said spool shaft to said accommodating portion or from said accommodating portion to said spool shaft;

first rotating means engageable with said spool shaft of said cartridge positioned at a predetermined position of said loading portion, for rotating said spool shaft at torque lower than rotational torque of said heat roller;

second rotating means engaging with said take-up shaft, for rotating said take-up shaft at torque lower than the rotational torque of said heat roller; and switching means for switching between a first position, at which said first rotating means is rotated at a speed slower than a speed of said heat roller and said second rotating means is rotated at a speed faster than the speed of said heat roller when said photographic film is withdrawn from said spool shaft, and a second position, at which said first rotating means is rotated at a speed faster than the speed of said heat roller and said second rotating means is rotated at a speed slower than the speed of said heat roller when said photographic film is taken up onto said spool shaft.

17. A photographic film curling correcting apparatus according to claim 16, wherein said first rotating means and said second rotating means are rotated by driving force of said conveying means via a friction means, and a difference in rotation of said spool shaft, said heat roller and said take-up shaft is absorbed by said friction means.

* * * * *